US007000543B2

(12) United States Patent
Klein et al.

(10) Patent No.: US 7,000,543 B2
(45) **Date of Patent: *Feb. 21, 2006**

(54) METHOD AND APPARATUS FOR LOADING AND UNLOADING FLEXOGRAPHIC PLATES FOR COMPUTER-TO-PLATE IMAGING

(75) Inventors: Thomas Klein, Wolfenbucttel (DE); Jan Buchweitz, Huje (DE)

(73) Assignee: Esko-Graphics A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 10/821,249

(22) Filed: Apr. 8, 2004

(65) Prior Publication Data

US 2004/0255806 A1 Dec. 23, 2004

Related U.S. Application Data

(63) Continuation-in-part of application No. 10/791,305, filed on Mar. 2, 2004.

(60) Provisional application No. 60/461,706, filed on Apr. 9, 2003.

(51) Int. Cl.
*B41L 47/17* (2006.01)
*B65H 1/04* (2006.01)

(52) U.S. Cl. ..... 101/477; 414/796.7; 414/331.14

(58) Field of Classification Search ..... 101/477, 101/483, 401.1; 414/796.6, 796.7, 796.8, 414/796.9, 797, 331.01, 331.11, 331.14, 331.16
See application file for complete search history.

(56) References Cited

U.S. PATENT DOCUMENTS

| | | | | |
|---|---|---|---|---|
| 4,354,336 | A | 10/1982 | Azzaroni | 53/505 |
| 4,539,794 | A * | 9/1985 | Azzaroni | 53/493 |
| 4,611,967 | A | 9/1986 | Tsutsui | 414/411 |
| 4,878,799 | A | 11/1989 | Seto et al. | 414/331 |
| 5,127,328 | A | 7/1992 | Wieland | 101/415.1 |
| 5,246,326 | A * | 9/1993 | Boutet | 414/609 |
| 5,738,014 | A | 4/1998 | Rombult et al. | 101/477 |
| 5,964,156 | A | 10/1999 | Smith et al. | 101/471 |
| 5,992,324 | A | 11/1999 | Rombult et al. | 101/477 |
| 6,085,657 | A | 7/2000 | Rombult et al. | 101/471 |
| 6,113,346 | A | 9/2000 | Blake et al. | 414/811 |
| 6,189,452 | B1 | 2/2001 | Halup et al. | 101/415.1 |
| 6,341,932 | B1 | 1/2002 | Otsuji | 414/403 |
| 6,354,208 | B1 | 3/2002 | Bos et al. | 101/463.1 |
| 6,422,801 | B1 | 7/2002 | Solomon | 414/416.07 |
| 6,536,344 | B1 | 3/2003 | Kawamura et al. | 101/477 |
| 2003/0001946 | A1 | 1/2003 | Nomoto et al. | 347/254 |

* cited by examiner

*Primary Examiner*—Leslie J. Evanisko
(74) *Attorney, Agent, or Firm*—Dov Rosenfeld; Inventek

(57) ABSTRACT

A method and apparatus to aid the loading and unloading of flexographic plates to and from an imager. The apparatus includes a magazine containing a plurality of compartments each for holding a single flexographic plate, the compartments arranged vertically, and movable in a vertical direction, a lifting mechanism to lift and lower the compartments; and a control system to control the lifting and lowering by the lifting mechanism. The control system is such that a particular compartment is moved from its rest vertical position at a rest horizontal position to a loading vertical position and a loading horizontal position at which the particular compartment is at a height for loading onto the imager. The loading is automatic and in the case that the plate includes a protective sheet thereon, the loading includes removing the protective sheet from the plate.

26 Claims, 25 Drawing Sheets

METHOD AND APPARATUS FOR LOADING AND UNLOADING FLEXOGRAPHIC PLATES FOR COMPUTER-TO-PLATE IMAGING

RELATED APPLICATION(S)

This invention is a continuation-in-part of U.S. patent application Ser. No. 10/791,305 titled METHOD AND APPARATUS FOR LOADING AND UNLOADING FLEXOGRAPHIC PLATES FOR COMPUTER-TO-PLATE IMAGING, filed Mar. 2, 2004. U.S. patent application Ser. No. 10/791,305 claims priority of U.S. Provisional Patent Application 60/461,706 filed Apr. 9, 2003. U.S. patent application Ser. No. 10/791,305 and U.S. Provisional Patent Application 60/461,706 are both incorporated herein by reference.

BACKGROUND

This invention relates to computer-to-plate (CTP, C2P) imaging for flexographic ("flexo") printing, and in particular, to a method and apparatus for loading and unloading flexographic plates onto an imaging device for imaging the flexographic plates.

Flexographic plates designed for CTP imaging are typically photopolymer plates that are pre-sensitized with a Laser Ablation Mask System (LAMS) coating. Such coatings are known to be easily damaged during handling. Pre-sensitized plates, including flexo-plates for flexographic CTP imaging come as a stack with a separation sheet between consecutive plates. In addition, LAMS coated flexographic plates come with a cover sheet that adheres to the top of the LAMS coating to protect it against mechanical damage. This protective sheet is difficult to remove without damaging the LAMS coating or the plate itself. In addition, such plates can be relatively large, up to about 50" by 80", with a thickness of up to about 6 mm. Each such plate can weigh as much as 15 kg.

These properties make plate loading for CTP flexographic imaging relatively complicated. As a result, modern flexographic CTP imagers are manually loaded and unloaded. Plate loading tables are available that help the manual process. Such tables are either movable, e.g., on wheels, or are integrated into the machine itself. Each plate, e.g., pre-loaded on the loading table, is carried individually from the plate storage area to the CTP flexographic imager, and, after imaging is completed, carried further onwards, e.g., to a processing area where to be processed by a processing system, e.g., exposed by a UV exposure unit then processed by a chemical processing unit.

The requirement to move the plates one-by-one significantly slows down the workflow. With a typical state-of-the art system using a transportable loading table, for a large plate, it may take about 2 minutes to load a first plate, about 10 minutes to image the first plate, about 2 minutes to unload the first plate, about 5 minutes to carry the first plate to the UV exposure unit of the processing system, then 2 minutes to load a second plate, and so forth. Thus, for 10 minutes imaging time, there is about 9 minutes of downtime. This is approximately 45% of the total time.

The efficiency can be increased if more than one operator is involved, e.g., a second operator to transport and load the second plate while the first plate is being transported to the processing area. However, an additional operator is relatively expensive.

There thus is a need to improve the overall productivity of flexographic plate imaging, especially in a single operator environment, by improving the loading and unloading.

FIG. 2 shows a prior art CTP imaging system that is described in U.S. Pat. No. 6,341,932 to Otsuji titled PLATE FEEDING APPARATUS AND METHOD, incorporated herein by reference, and referred to herein as the "Otsuji system." The Otsuji system comprises a plate feeding apparatus 2 that includes a multiple cassette station 5 having a plurality of cassettes 7 arranged one over the other, each cassette holding a stack of plates. The Otsuji system also comprises a loader 6 that includes a slide mechanism for horizontally moving a particular one of the plurality of cassettes from the stack to the loader and a lift mechanism for supporting and vertically moving the particular cassette 7 to a plate feed position. A transport mechanism in loader 6 transports a plate from the particular cassette to the image recording apparatus (imager) after the particular cassette is at the plate feed position. The imager is not shown in FIG. 2, but is behind the two mechanisms 5 and 6 so that feeding a plate involves moving a plate into the plane of the page. The loader 6 includes a slip sheet discharge mechanism that picks up and discharges slip sheets each disposed between an adjacent pair of the plates in the particular cassette 7 at the feed position.

FIG. 3 is taken from U.S. Pat. No. 5,738,014 to Rombult, et al. titled METHOD AND APPARATUS FOR MAKING LITHOGRAPHIC PRINTING PLATES IN AN AUTOMATED COMPUTER TO PLATE IMAGING SYSTEM, and incorporated herein by reference. FIG. 7 shows a CTP imaging system 16, referred to herein as the "Rombult system" that includes a plate handler 18 that contains a supply of plate cassettes 24. The handler 18 can hold as few as two cassettes or as many as three, four, or five depending on user requirements. Each cassette 24 is a light tight container that houses a stack of plates 26, typically lithographic plates. The cassettes 24 can be vertically adjusted by the handler 18 to make plates 26 stored within a particular cassette available to a plate shuttle mechanism (a plate picker 28). The picker 28 removes a single plate from the stack in the selected cassette and transports the plate between the handler 18 and an imager 20. The primary function of the handler 18 is to make plates available on demand to the imager 20. Between each plate in a stack there may be a protective interleaf sheet or slip sheet that is removed by the handler and discarded by a slip sheet removal mechanism 25. The Rombult system 16 includes an optional on-line plate processor and stacker to process the plates after exposure by the imager 20. The Rombult system 16 is controlled by a controller 30.

Each cassette in the Otsuji system and the Rombult system stores a stack of a plurality of pre-sensitized plates with a slip sheet between the plates. One use of the Otsuji system and the Rombult system is for each cassette to store a stack of plates of a different size and/or different thickness so that different size/thickness plates are always available to the imager.

The present invention further addresses a different problem. In practice, it is very difficult to stack flexographic plates. The operation of removing the protective sheet on top of the LAMS coating is a relatively delicate operation. Thus a system such as the Otsuji system or the Rombult system wherein each cassette includes a plurality of plates may not be suitable for flexographic plates. The Rombult system patent acknowledges that it is for lithographic CTP imaging for the purpose of supplying the plates of the appropriately sized cassette on demand, and is shown operating with an internal drum scanner. Size is also an important consideration. The Otsuji system's plate feeding apparatus 2 includes a cassette station 5 and a loader 6 that each requires about the same floor area.

Thus there still is a need for a method and apparatus to aid in the loading and unloading of LAMS-coated flexographic plates for CTP imaging.

Flexographic plates can be relatively large, so that there is a need for a loading method and apparatus for flexographic plates that is economical in floor area requirements.

There further is a need for a method to automate the process of loading and unloading flexographic plates, including removing the protective sheets.

SUMMARY

Described herein are a method and apparatus to aid the loading and unloading of flexographic plates to and from an imager. The apparatus includes a magazine containing a plurality of compartments each for holding a single flexographic plate, the compartments arranged vertically, and movable in a vertical direction, a lifting mechanism to lift and lower the compartments; and a control system to control the lifting and lowering by the lifting mechanism, and in one aspect, the loading of a plate onto the drum and the removal of a protective sheet from the plate. The control system is such that a particular compartment is moved from its rest vertical position at a rest horizontal position to a loading vertical position at which the particular compartment is at a height for loading onto the imager.

In one embodiment, each compartment, when at its loading vertical position, is movable horizontally from and to the rest horizontal position to and from a loading horizontal position suitable for loading and unloading the plate on the compartment onto and from the imager.

Once the selected compartment is at its loading horizontal position suitable for loading the plate, an automatic plate mover automatically moves the plate horizontally to an intermediate position. At the intermediate position, the plate is restrained on a side opposite to the side whereon a protective sheet lays, and while restrained, any protective sheet on the plate is partially lifted and held. The plate is then further moved to an imager loading horizontal position, then onto the imager while the protective sheet is held. As the plate is loaded onto the imager, the holding of the protective sheet removes the protective sheet from the plate, such that the plate is loaded onto the imager without the protective sheet.

The protective-sheet is discarded

After imaging, the plate is automatically unloaded to the intermediate position then to the loading horizontal position suitable to unloading the plate.

In an alternate embodiment, the magazine is moved to an intermediate horizontal position prior to being moved to its loading horizontal position. An automatic plate mover automatically moves the plate horizontally from the magazine at the intermediate position to provide access to the bottom of the plate opposite to the side whereon a protective sheet lays. At the intermediate position, the plate is restrained on such bottom side, and while restrained, any protective sheet on the plate is partially lifted and held. The magazine and plate are now further moved horizontally to the loading horizontal position, and then the plate is further moved to an imager loading horizontal position, then onto the imager while the protective sheet is held. As the plate is loaded onto the imager, the holding of the protective sheet removesd the protective sheet from the plate, such that the plate is loaded onto the imager without the protective sheet.

In one embodiment, the lifting mechanism is operative to lift and lower the complete magazine of compartments. The control system controls the lifting and lowering of the magazine until a selected one of the compartments is at its loading vertical position.

In another embodiment, the lifting mechanism is operative to lift and lower the compartments of the magazine one compartment at a time. In one version, the respective rest positions of each of the compartments are lower than the loading vertical position such that a particular compartment pre-loaded with a plate is lifted from its rest vertical position to the loading vertical position, then moved while at the loading vertical position to the loading horizontal position for loading onto the imager.

Other features and variations will be clear from the detailed description below, including the drawings.

DETAILED DESCRIPTION

Described herein is a method and apparatus to aid the loading and unloading of sensitive plates that are difficult to stack one on top of the other, such as flexographic plates. The loading and unloading is onto and from a CTP imager. In one embodiment, the CTP imager is an external drum imager.

To speed up the plate handling process, a plate magazine containing a plurality of flexographic plates is used. One embodiment can contain at least 10 plates, e.g., about 20 plates. The magazine includes a plurality of compartments, one compartment for each plate. Each flexographic plate is pre-loaded in its own compartment, e.g., without the separation sheet that may have been used between plates from in a stack of flexographic plates. In one embodiment, the flexographic plate is pre-loaded without the protective sheet over the LAMS coating, while in the preferred embodiment, the protective sheet remains over the LAMS coating. In one version, the protective sheet is removed directly prior to the plate being mounted on the drum. In the preferred embodiment, the protective sheet partially removed prior to the loading, is mostly still on top of each flexographic plate. The removal of the rest of the protective sheet occurs automatically at the same time as the mounting.

In one embodiment the plate magazine pre-loaded with plates is transported to a location adjacent to the flexographic imager, so that plates are immediately available for imaging. In another embodiment, the plate magazine is integrated with the CTP imager.

Figure 1:
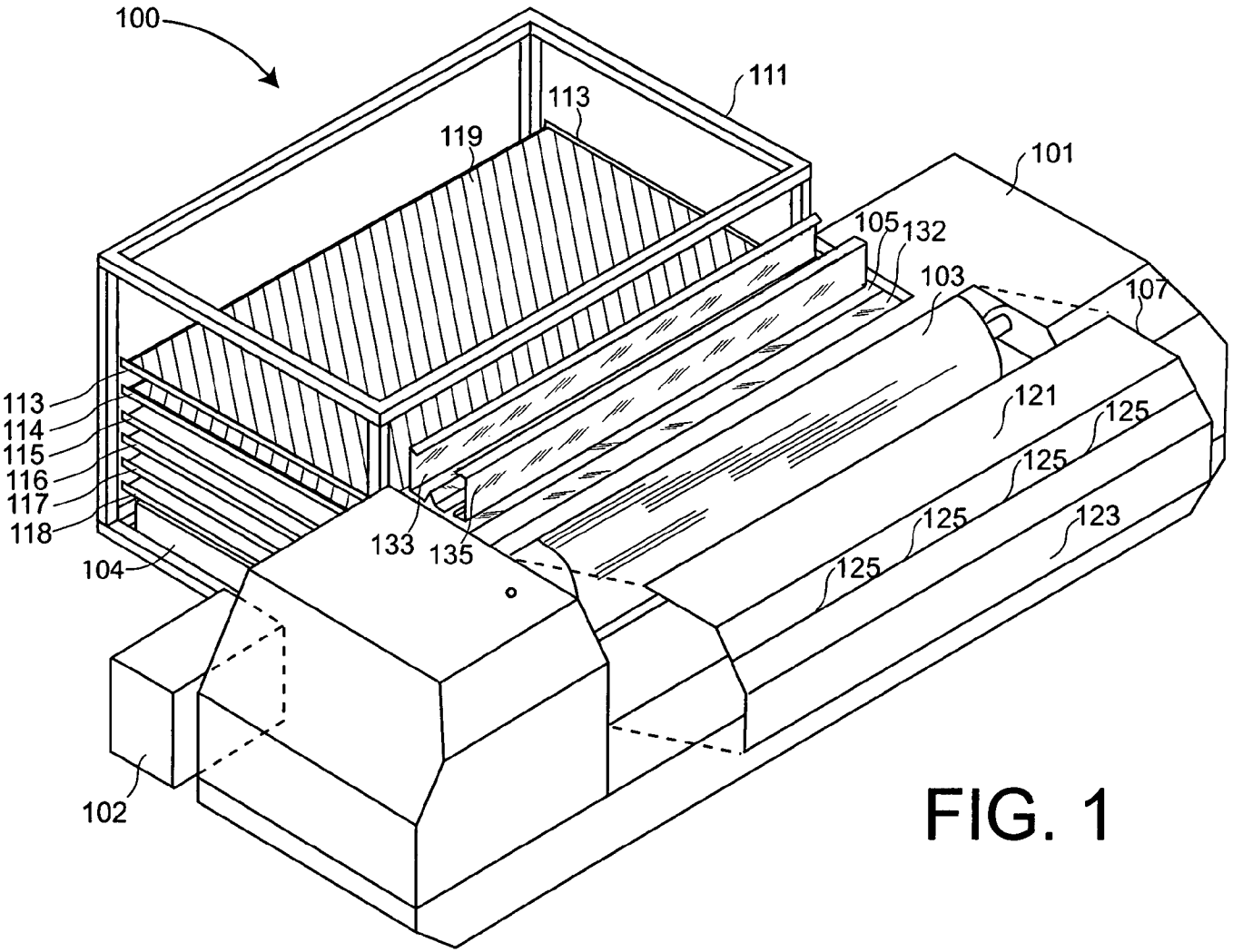
FIG. 1 shows in simplified form one embodiment of a CTP flexographic plate loading and unlading apparatus and an imager for imaging on CTP flexographic plates.
Figure 2:
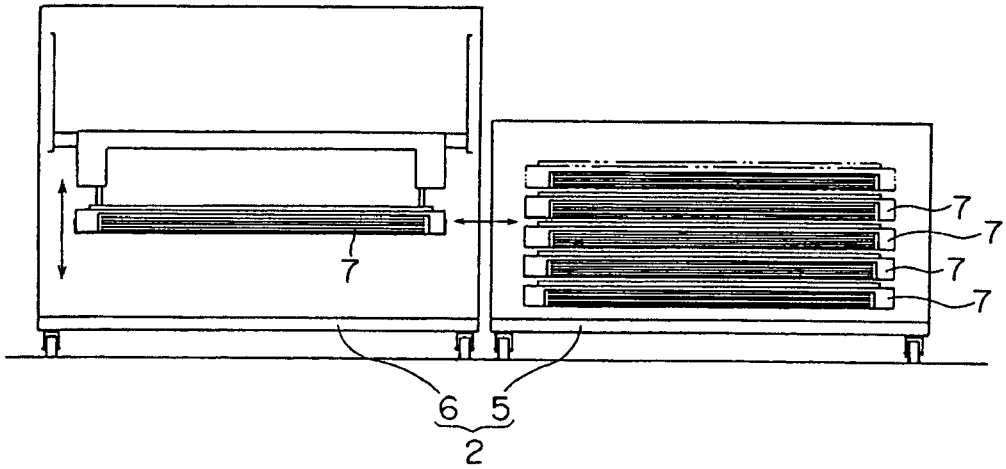
FIG. 2 (PRIOR ART)
FIG. 2 shows a prior art plate loading system that uses cassettes in which a stack of unexposed plates, e.g., CTP lithographic plates is kept.
Figure 3:
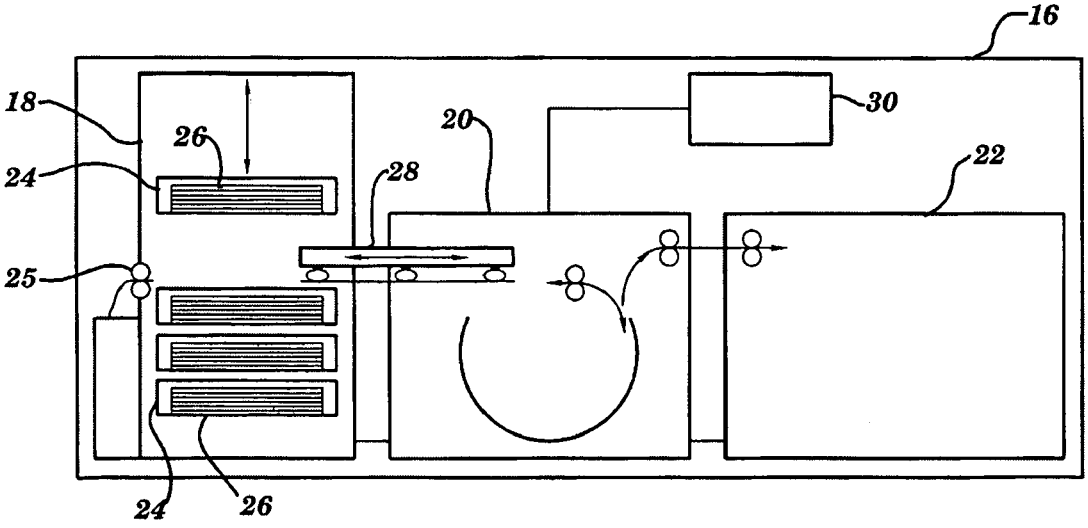
FIG. 3 (PRIOR ART)
FIG. 3 shows another prior art plate loading system that uses cassettes in which a stack of unexposed plates, e.g., CTP lithographic plates is kept.

FIG. 1 shows one embodiment of a system 100 that includes an external drum imager 101 for flexographic plates and a novel loader that includes a magazine containing a plurality of compartments each for holding a single flexographic plate. (also possible to load more than one plate into each compartment—see general comments in the e-mail).

One embodiment of the imager 101 includes a rotatable drum for loading a flexographic plate thereon. A door mechanism 107 provides access to the drum for loading and unloading and is closed during imaging. In order to show the drum in FIG. 1, the door mechanism 107 is shown removed from its proper location as indicated by the dashed lines. One embodiment of the door mechanism includes a first door part 121 and a second door part 123 hinged to each other by hinge 125. The two door parts 121 and 123 further include hinges, not shown so as not to obscure the inventive aspects. The imager 101 includes a laser source (or several laser sources) that provides one or more laser beams modulated by imaging data, e.g., sets of data for each of a plurality of color separations for exposing the respective plates for a color print. The laser(s) is/are suitable for exposing CTP flexographic plates, e.g., is/are matched in energy and wavelength to the particular type of LAMS coating on the flexographic plates. An example of one such flexographic imager 101 is the Esko-Graphics Cyrel® Digital Imager (Esko-Graphics, Gent, Belgium) made by Esko-Graphics, the assignee of the present invention.

In order not to obscure the inventive aspects, the magazine is shown in FIG. 1 in simplified form and having only six compartments that are spaced further apart than in an actual embodiment.

In one embodiment, the magazine includes a frame 111 and a set of compartments 113, 114, 115, 116, 117, and 118 arranged vertically, each compartment designed for holding a single flexographic plate. The top compartment is compartment 113, and the bottom compartment is compartment 118. FIG. 1 shows a plate 119 in the top compartment 113 and another plate in the next compartment 114. The compartments are movable up and down. A lifting mechanism 104—part of which is shown in FIG. 1—lifts and lowers the compartments under control of a control system 102. Initially, each of the compartments is at its respective rest vertical position and a common rest horizontal position.

In one embodiment, the lifting mechanism moves one compartment at a time vertically between its rest vertical position and a loading vertical position at which the compartment is at a height at which the compartment is horizontally movable back and forth from the rest horizontal position to a loading horizontal position flush with a loading area 105. The lifting mechanism 104 further can move each compartment at the rest horizontal position up and down from and to the loading vertical position to and from a respective imaged vertical position.

We should put in here a description of the alternative embodiment—where the compartment also serves as the horizontal loading plane (see general comments in the e-mail).

The loading area 105 is substantially planar and horizontal. In one embodiment, the loading area 105 includes a movable horizontal bottom panel 132 that when moved beneath the horizontal area 105 provides an opening for access from below the loading area.

One aspect of the invention is the automatic loading of a plate onto the drum, and another aspect is the automatic removal of a protective sheet from the top of the plate during the loading onto the drum. These aspects are controlled under control of the control system 102.

The edge of the plate closest to the imager when the plate is at the horizontal loading position is called the front edge, and that furthest from the imager is called the far edge.

The system further includes a first grabber mechanism 135 that includes a section 133 to maintain the plate horizontal, and that includes a first set of vacuum (suction cups) arranged as a row. When the compartment is at it's loading horizontal position flush with a loading area 105, the first mechanism with the first set of suction cups grabs the plate with the protective sheet on top and moves the plate and sheet away from the cassette towards the drum on the loading area 105, such that the edge of the plate and protective sheet is above the opening formed by moving away bottom panel 132.

When the plate is at the intermediate position over the opening 507, the first mechanism 135 lets go of and moves away from the protective sheet and plate. In particular, the first mechanism rotates such that the edge of the plate may be bent away from the surface 105. The part 133 of the grabber mechanism 135 maintains the adjacent part of the plate and protective sheet horizontal.

A bending device (not shown in FIG. 1) that in one embodiment includes a wheel that rolls against the edge of the plate moves back and forth across the plate edge. This bends approximately 10 mm of the end of the plate and protective sheet to an angle that is adjustable to between 30 and 90 degrees, depending on the plate type. The bending device moves back and forth across the plate edge between one and three times depending on the plate type. The purpose of the bending by the bending device is to loosen the protective sheet from the plate at the edge region. Otherwise, the protective sheet tends to stick heavily to the LAMS coating. The bending device might also be a knife-type device instead of a wheel.

At this stage, the first mechanism 135 that includes the first set of suction cups arranged as a row moves onto the protective sheet along the width in the strip area separated from the plate. Also at this stage, a second mechanism (not shown in FIG. 1) that includes a second set of vacuum holders (suction cups) arranged as a row moves to be under the edge of the plate through the opening in the loading area 105. The order of the moving is not important, i.e., whether the top protective sheet or the bottom of the plate is held first. Vacuum is applied to the first and second set of vacuum holders. The second set maintains the plate at the horizontal surface, while the first mechanism lifts, e.g., by tilting tilts the protective sheet away from the plate.

In one embodiment, the first set of suction cups of the first mechanism is arranged relative to the second set of suction cups such that the top (first set) suction cups are interleaved with the bottom (second set) suction cups. However, the inventors discovered that the mechanisms still cooperate to produce the desired result, albeit not as well, even when the top and bottom sets of suction cups are not so interleaved, e.g., are positioned at the same location when respectively adhering to the protective sheet and to the bottom of the plate. Thus, the invention is not restricted to the interleaving of the first set and second set suction cups.

The vacuum to the bottom second set of suction cups is removed, and the second mechanism of the second set of (the bottom) suction cups is moved away. The movable panel 132 now moves back to close the opening to form a substantially horizontal surface.

The grabber mechanism 135 with the vacuum holders holding the protective sheet now slides the plate and protective sheet towards the drum.

A clamping mechanism, in one embodiment, a T-clamp, is open and the plate is moved until the plate edge is under the T-clamp. The loosened section of the cover sheet is held upwards by the grabber to not fall below the clamp area. The T-clamp now closes to grip the plate.

Once the plate edge is clamped to the drum, two actions occur. The first mechanism moves horizontally back to its horizontal rest position close to being over the movable part 132. The first set of suction cups maintains hold on to the protective sheet such that the sheet is partially peeled away.

The second motion is that the drum rotates. The rotation of the drum with the plate clamped thereon while the first set of suction cups still holds on to the protective sheet further removes the protective sheet from on top of the plate, while the plate is loaded on to the drum.

The first and second motion is coordinated. In one embodiment, the backwards movement of the first mechanism 135 occurs simultaneously with the rotation of the drum. This is the preferred embodiment because it avoids damages to the LAMS that might occur when the separation is not made in a single movement.

The protective sheet is now transported to a trash compartment.

In one embodiment, an anti-static device in the form of a wire across the width of the plate is included to remove static electricity from the combination of the plate and protective cover during the removal of the protective cover from the drum and automatic loading onto the drum. This ensures easier removal of the protective cover compared to when no anti-static device is used.

The unloading process proceeds in the reverse, except, of course, that there is now no protective sheet on top of the plate.

The above operation is described in more detail below with the aid of FIGS. 5A–5Y.

Note that while in the embodiment shown, the compartments' respective rest positions are bottom positions and the respective imaged positions are the compartments' respective top positions, in other embodiments, the order is reversed, e.g., the rest positions are top positions.

In one embodiment, the loader is movable. One version has wheels attached to the bottom of the supporting frame 111. Note that the wheels are not visible in FIG. 1. The loader is moved from an in initial location (the storage location) at which it is loaded with unexposed flexographic plates, one per compartment with no protective cover sheet, to a location adjacent to the imager 101 (the imaging location) as shown in FIG. 1.

After the plates are each imaged according to imaging data provided to the imager, in one embodiment, the loader is moved from the imaging location to a location (the processing location) where each plate is processed.

By having the compartments pre-loaded, the step of unstacking the plates can be done separately at the storage location, such that these steps do not interfere with the automatic loading of the plates on to the imager.

The operation of the one aspect of an embodiment of the plate loader of FIG. 1 is now described in more detail with the aid of FIGS. 4A–4J that show the system of FIG. 1 at different stages of loading, imaging, and unloading. These drawings, however, do not include the first and second mechanisms including the first and second set of suction cups used for the automatic loading and clamping of the plate onto the drum, and for the automatic removal of the protective sheet. These features were described above, and are shown and further described separately below with the aid of FIGS. 5A–5Y.

Figure 4A:
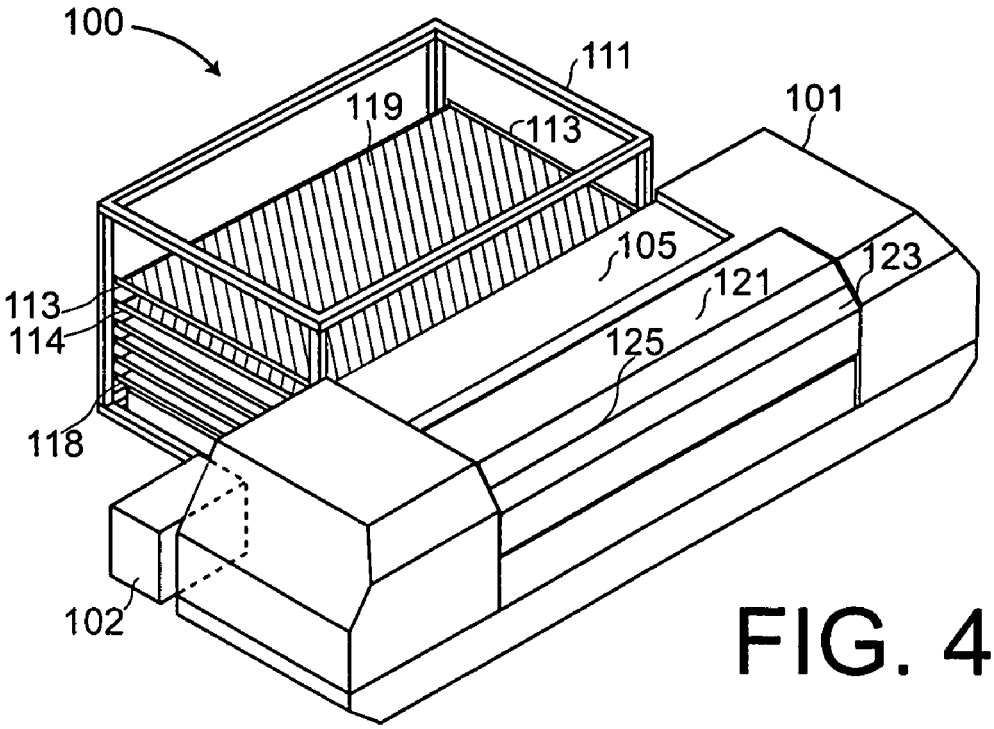
FIGS. 4A–4J each shows a different stage of operation of the system shown in FIG. 1, other than the automatic removal of the protective sheet and the automatic loading onto the drum shown in FIGS. 5A–5Y.
Figure 4B:
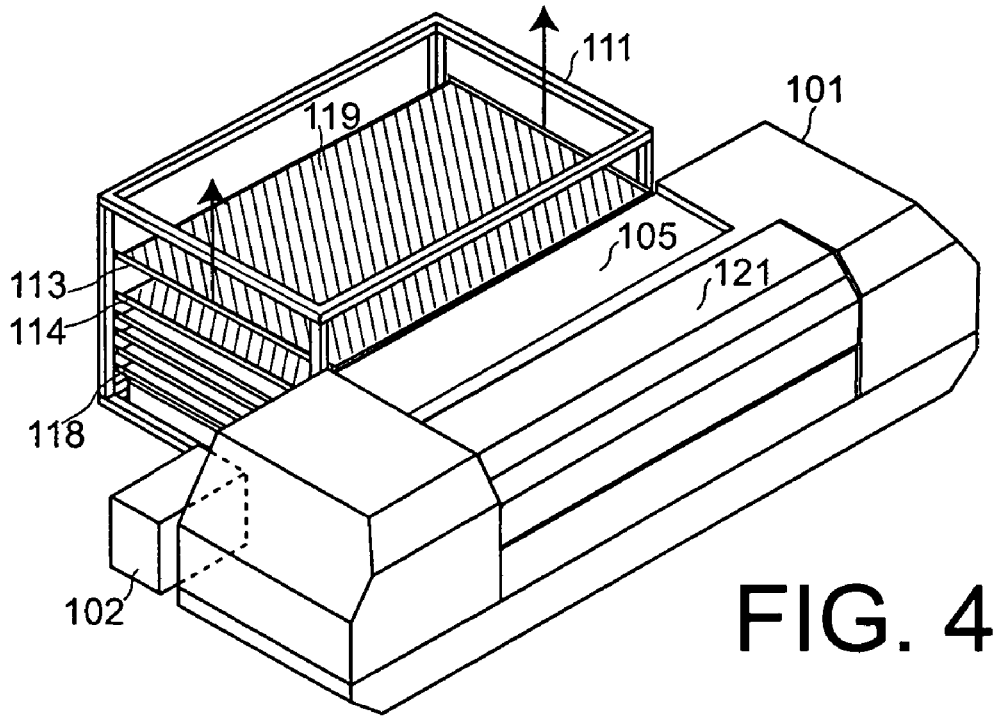
Figure 4C:
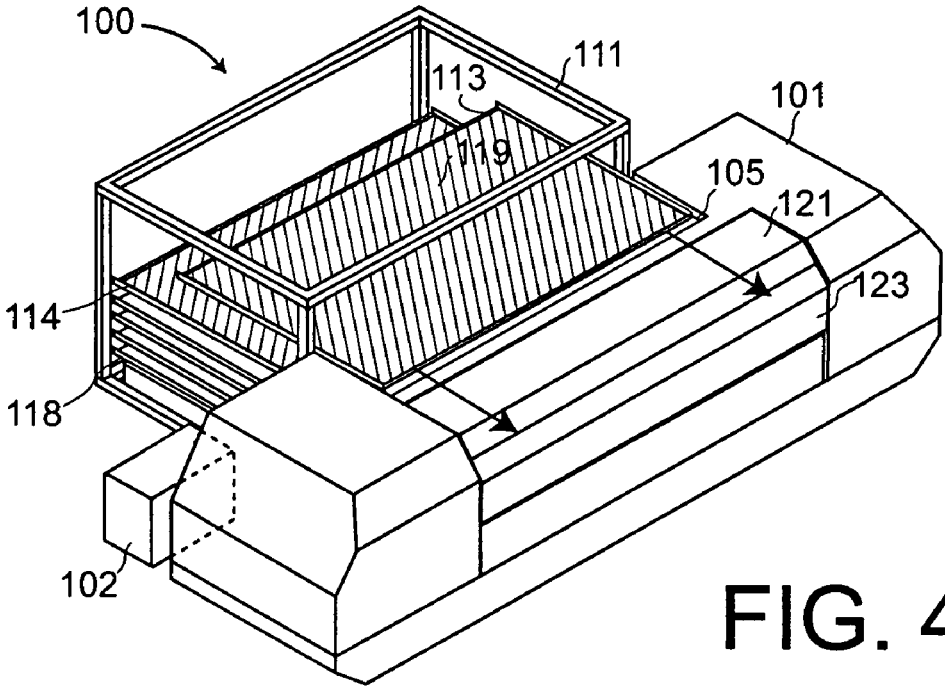

FIG. 4A shows the system with the compartments at their respective rest positions. In a step shown in FIG. 4B, compartment 113 containing CTP flexographic plate 119 is moved up by the lifting mechanism 104. The lifting mechanism under control of control system 102 stops compartment 113 when the compartment reaches the loading vertical position. FIG. 4C shows the compartment 113 at the loading vertical position moving horizontally to the loading horizontal position where it is flush with loading area 105. In one embodiment, the horizontal moving of the compartment uses a motor-driven horizontal movement mechanism under control of the control system 102. The horizontal movement mechanism is described in more detail below. In another embodiment, each compartment includes grips, e.g. on the side of the compartment that provide for the operator to manually move the compartment horizontally.

Figure 4D:
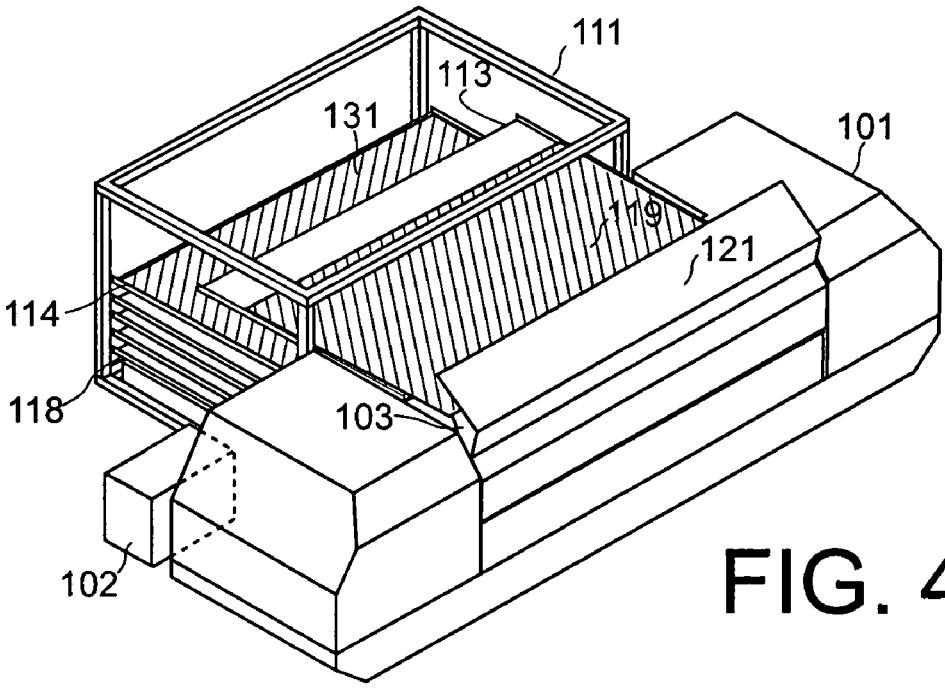
Figure 4E:
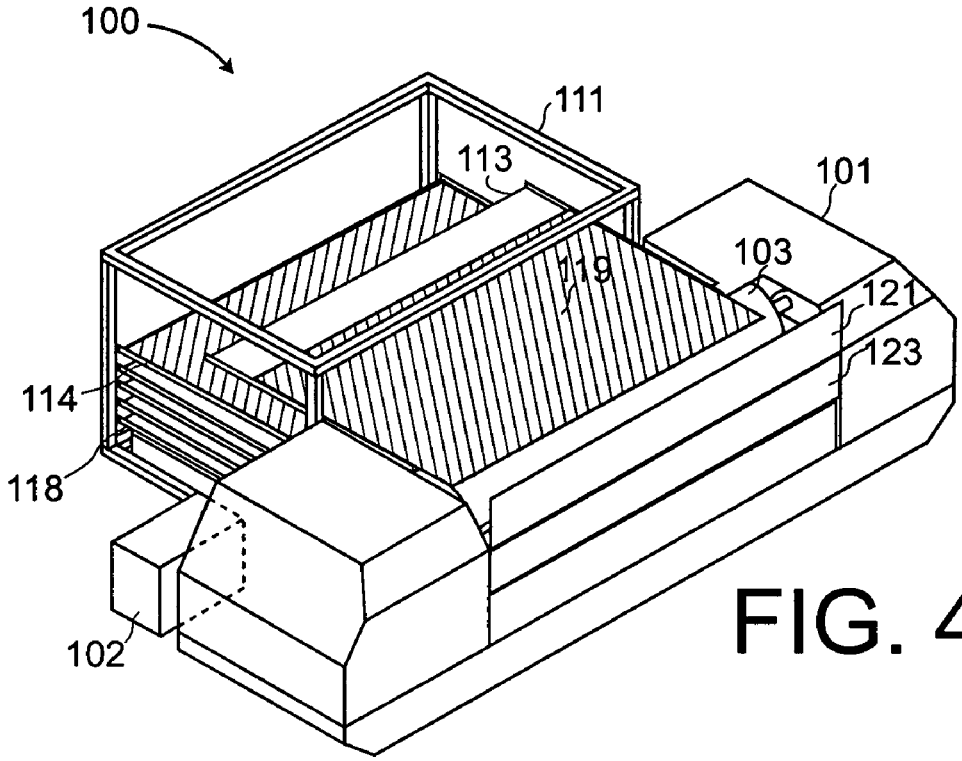

At the same time as the compartment moves horizontally, as shown in FIG. 4D, door part 121 of door 107 opens to allow the flexographic plate to be loaded onto the drum 103. FIG. 4E shows the start of the loading of the plate 119 onto the drum 103 of the imager 101, in one embodiment using a clamping mechanism on the drum 103.

Not shown in FIGS. 4D and 4E is the automatic loading and clamping of the plate onto the drum, and the automatic removal of the protective sheet. These features were described above, and are further described below with the aid of FIGS. 5A–5Y.

Figure 4F:
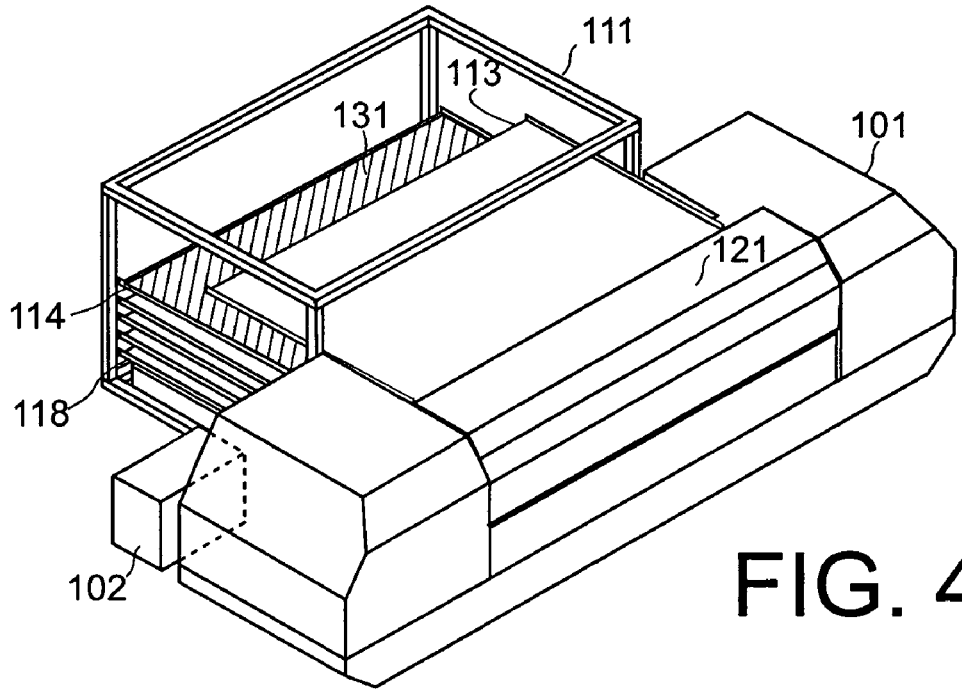
Figure 4G:
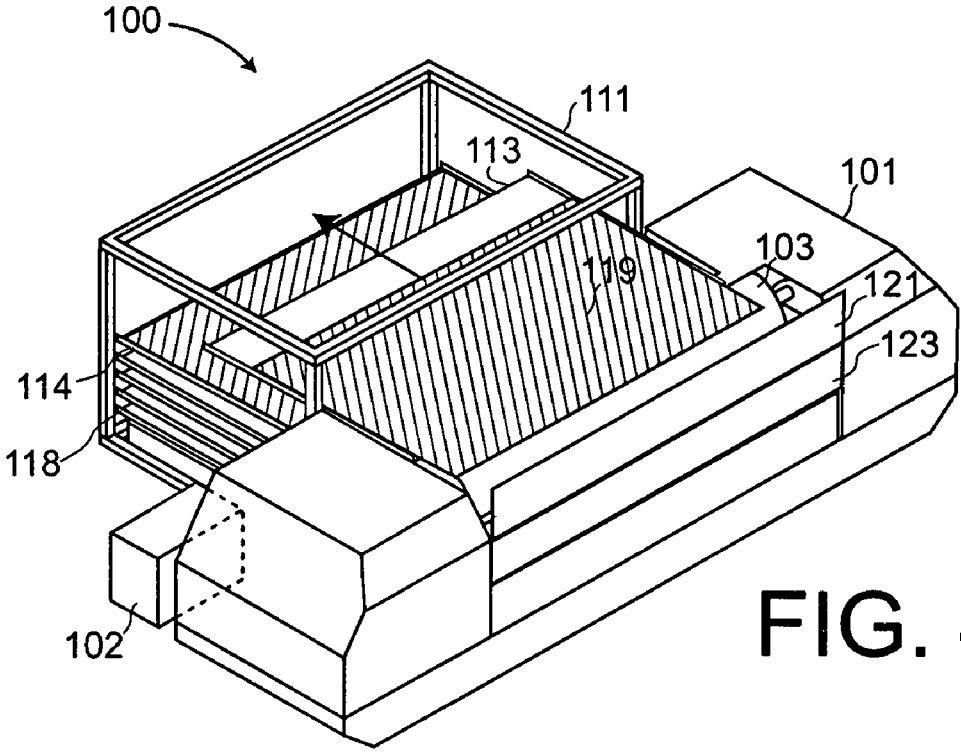
Figure 4H:
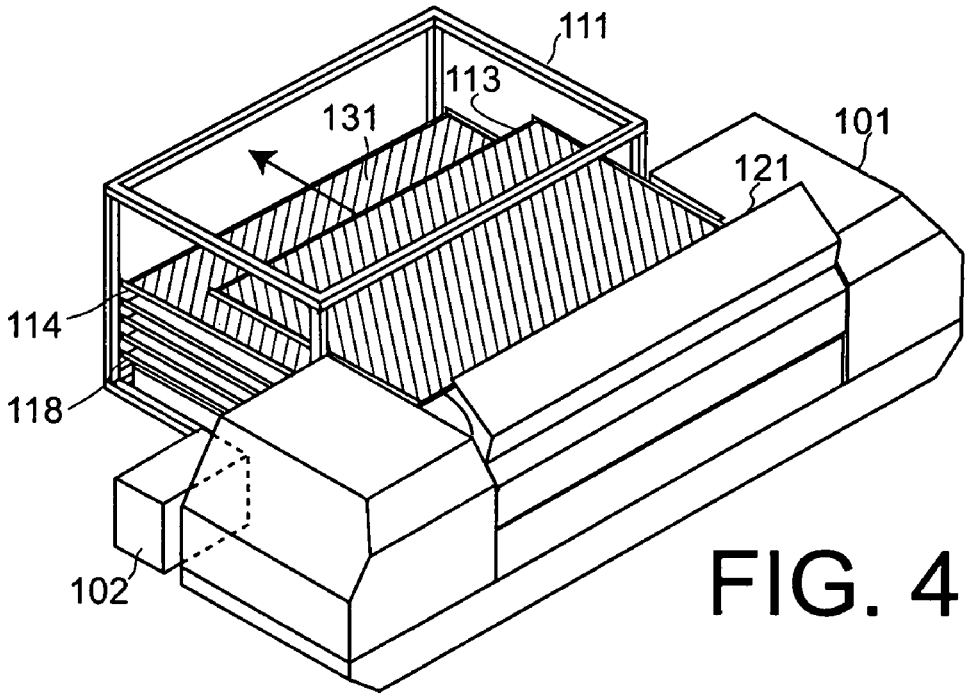
Figure 4I:
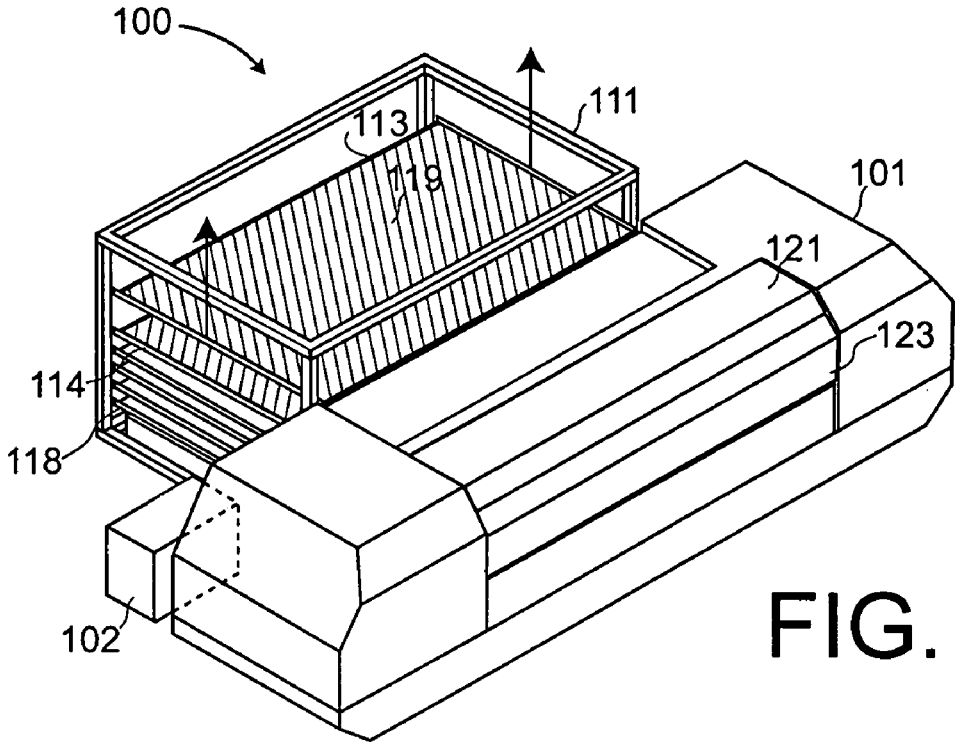
Figure 4J:
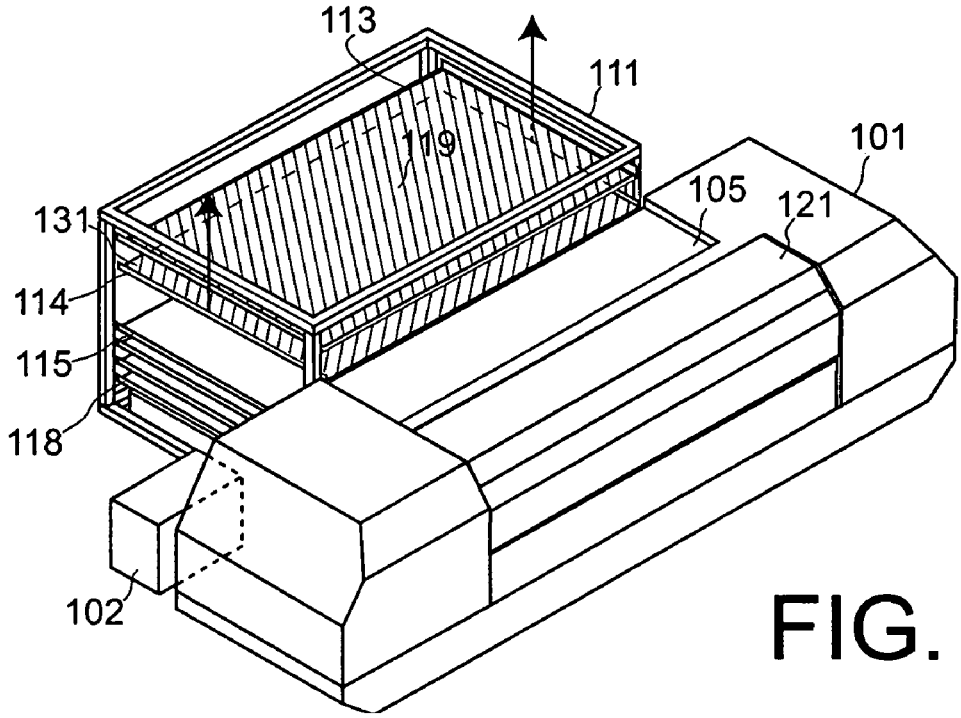

Note that in one embodiment, a T-clamp mechanism is used. Other clamping mechanisms may be used in alternate embodiments. The moving of the flexographic plate from the compartment 113 at a loading area 105 to the drum is carried out manually by an operator. The plate 119 is now wrapped around the drum and the door 107 closed. FIG. 4F shows the system during the operation of the imager at which time the plate 119 is imaged according to imaging data. After the imaging, the door 107 is opened to allow for unloading of the plate. FIG. 4G shows the plate being unloaded back onto the compartment 113. Once the imaged flexographic plate 119 is back in its compartment 113, FIG. 4H shows the compartment moving horizontally from the loading horizontal position to rest horizontal position at the loading vertical position. Note that the next plate to be imaged is the plate 131 in compartment 114. FIG. 4I shows the lifting mechanism 104 moving the compartment 113 from the loading vertical position to the compartment's imaged vertical position, which in this embodiment is the topmost position for the compartment. In other embodiments, this may be the bottom vertical position. The loading of plate 131 in compartment 114 now commences. FIG. 4J shows the lifting mechanism lifting compartment 114 from its rest vertical position to the loading vertical position. The loading and imaging and unloading of the next plate 131 proceeds as described above for the first plate 119.

The loading, exposing, and unloading continues until all plates in the compartments are exposed. The magazine with each compartment containing an imaged CTP flexographic plate is now transported to the processing location where the plates are processed.

Alternatively, an imaged plate may also be transported to an outlet compartment for immediate access, e.g., in the case there is a plate that needs to be more urgently made.

Note that FIGS. 4A–4J show the door 107 being closed during the moving of the compartments from their respective rest vertical position to the loading vertical position, and also the moving of the exposed plates from the loading vertical position to their respective exposed vertical positions. Of course there is no need to close and reopen the door 107 during this action, and in another embodiment, the door remains open except during imaging.

Note also that the order of imaging the plates may be random according to the imaging requirements. For example, in the case of a 20 compartment magazine, suppose the different sizes and or types of LAMS-coated flexographic plates are kept in the compartments. If the compartments are numbered 1, 2, . . . , 20, then the order of loading and imaging is not necessarily 1, 2, . . . , 20, but may be 1, 3, 2, 7, 4, and so forth depending on the needs.

Recall that with a state-of-the art prior art manual system using a transportable loading table, for a large plate, it may take about 2 minutes to load a first plate, about 10 minutes to image the first plate, about 2 minutes to unload the first plate, about 5 minutes to carry the first plate to the UV exposure unit of the processing system, then 2 minutes to load a second plate, and so forth. Thus, for 10 minutes imaging time, there is about 9 minutes of downtime. Using the system of FIG. 1, loading the first plate 119 could take 1 minute, imaging the plate 10 minutes, unloading plate 119 another 1 minute, loading plate 131, 1 minute, imaging plate 131, 10 minutes, and so forth. The carrying of the plates to the processing location occurs only after all the plates are imaged—or, alternatively, even while the last plate is still imaging to minimise downtime of the system. Thus, instead of the 5 minutes per plate, for a loader that contains 20 compartments, the 5-minute time is shared amongst the 20 flexographic plates, which comes to 0.25 minutes per plate. Thus, for 10 minutes imaging time, there is only 2.25 minutes of down time. Thus imaging is more than 81% of the total time. Note that with the addition of automatic loading of the plate from a compartment onto the imager, e.g., the drum of the imager, as described herein, exchanging a compartment can also occur simultaneous with the last plate being imaged, further reducing the downtime.

In one embodiment, any plate may also be accessed by an operator after imaging. In one embodiment, the plate is accessible from the back of the magazine. Thus, an imaged plate may be accessed and removed from its compartment and transported to the processing location while another plate is being imaged. This further increases the imaging efficiency. In yet another embodiment, the unloading is to a separate transportable outlet compartment. Thus the efficiency may be further increased by not waiting until all plates in the magazine are imaged before transporting the imaged plates to the processing location.

Figure 5A:
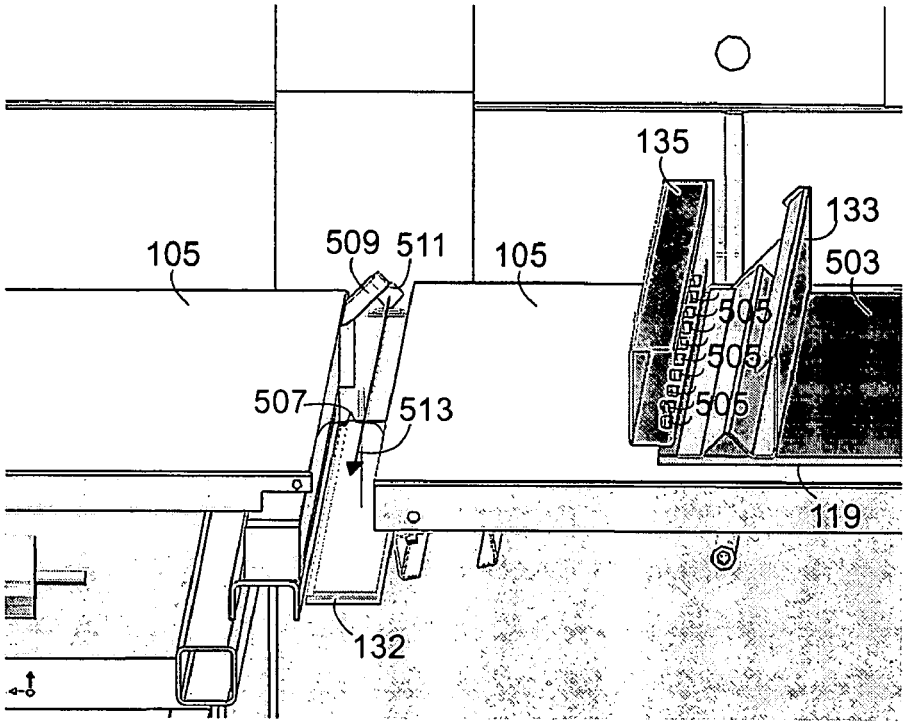
FIGS. 5A–5Y each shows a different stage of operation of one embodiment of the part of the system shown in FIG. 1 for the automatic removal of the protective sheet and the automatic loading onto the drum.
Figure 5B:
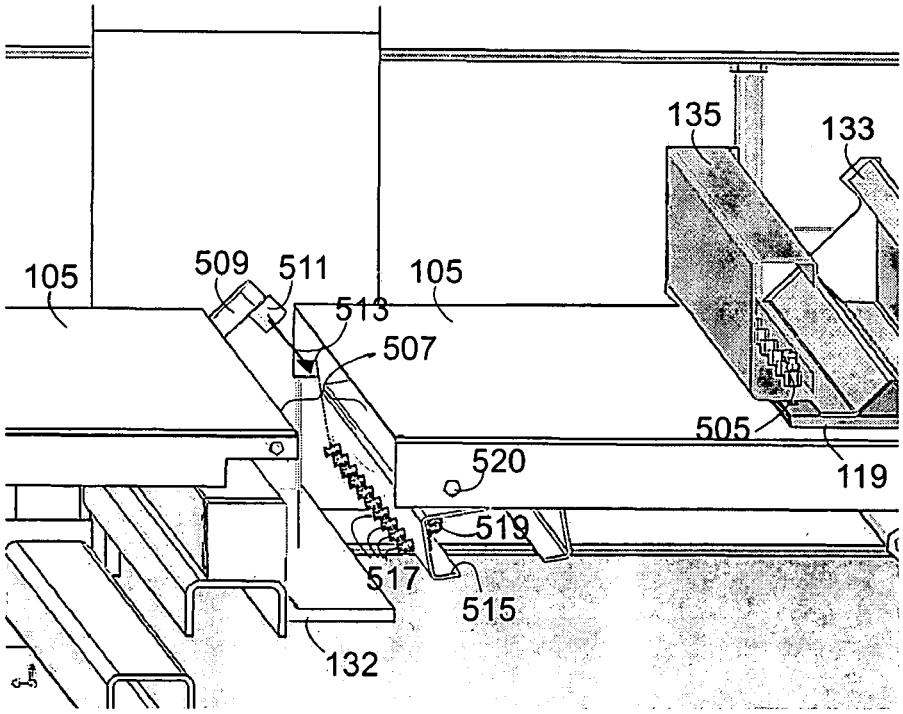
Figure 5C:
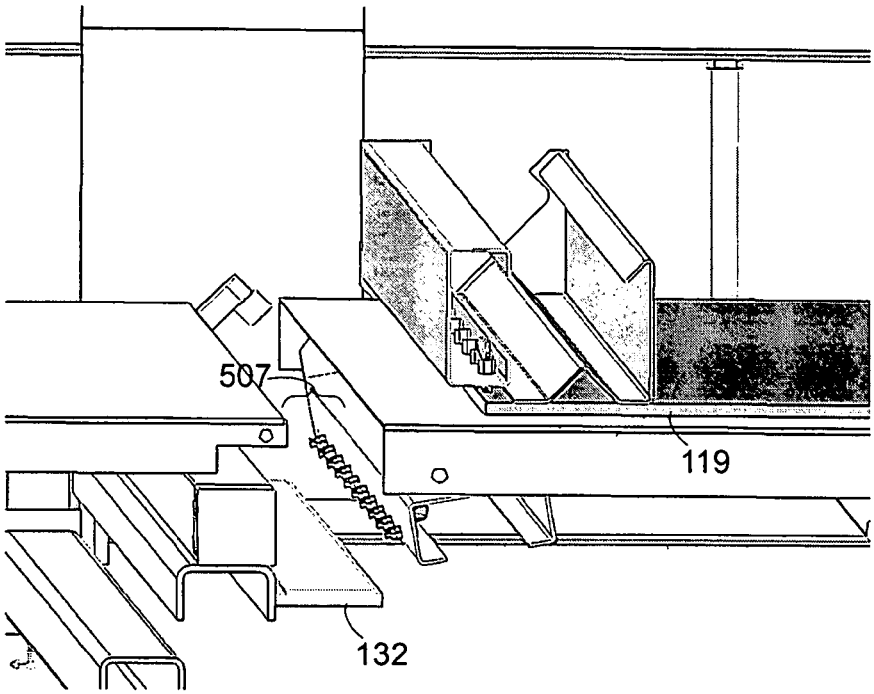
Figure 5D:
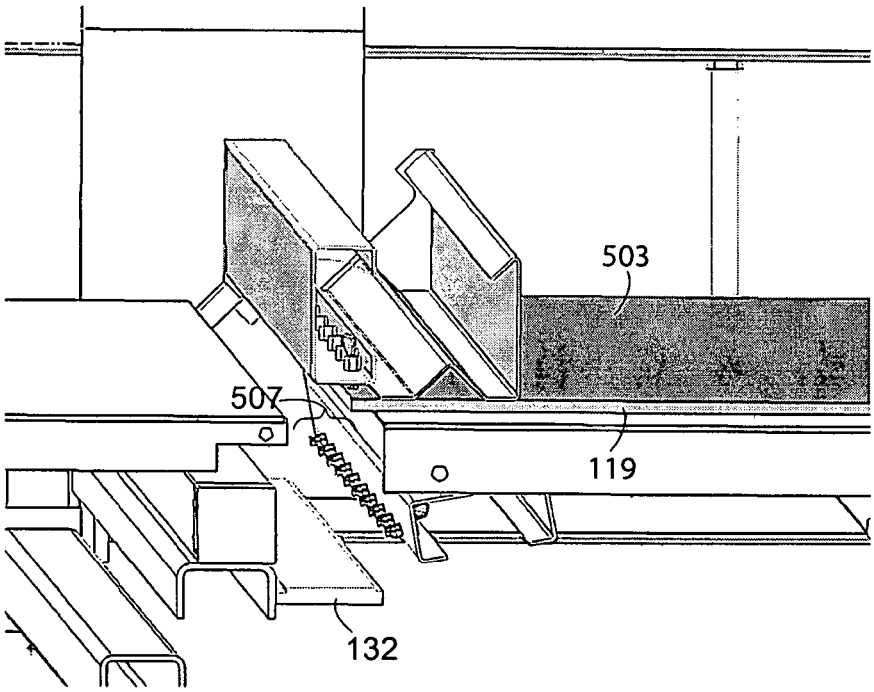
Figure 5E:
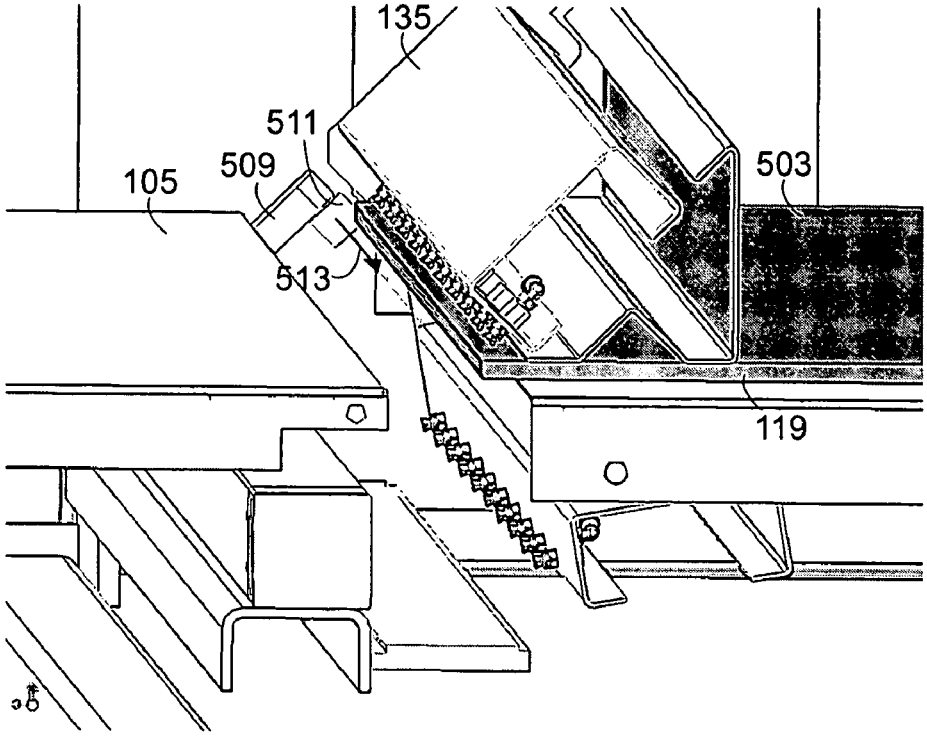
Figure 5F:
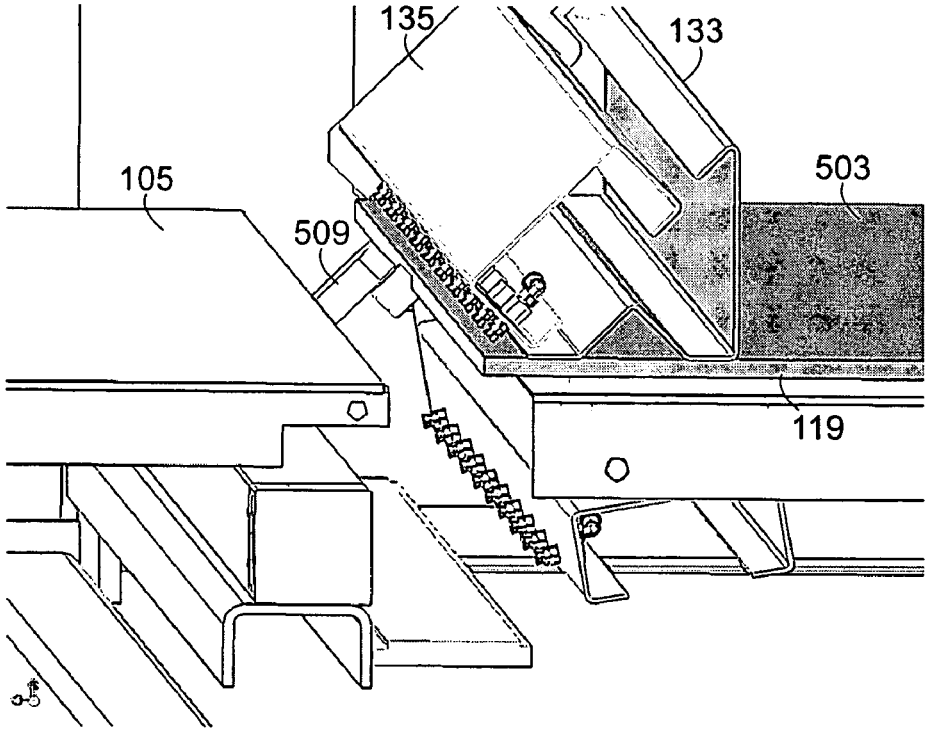
Figure 5G:
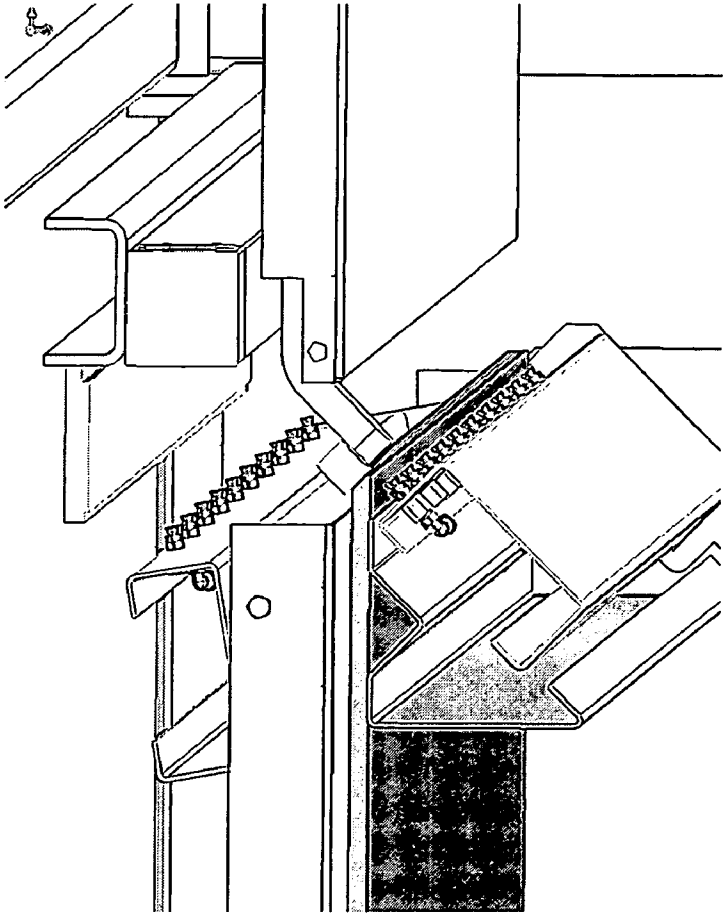
Figure 5H:
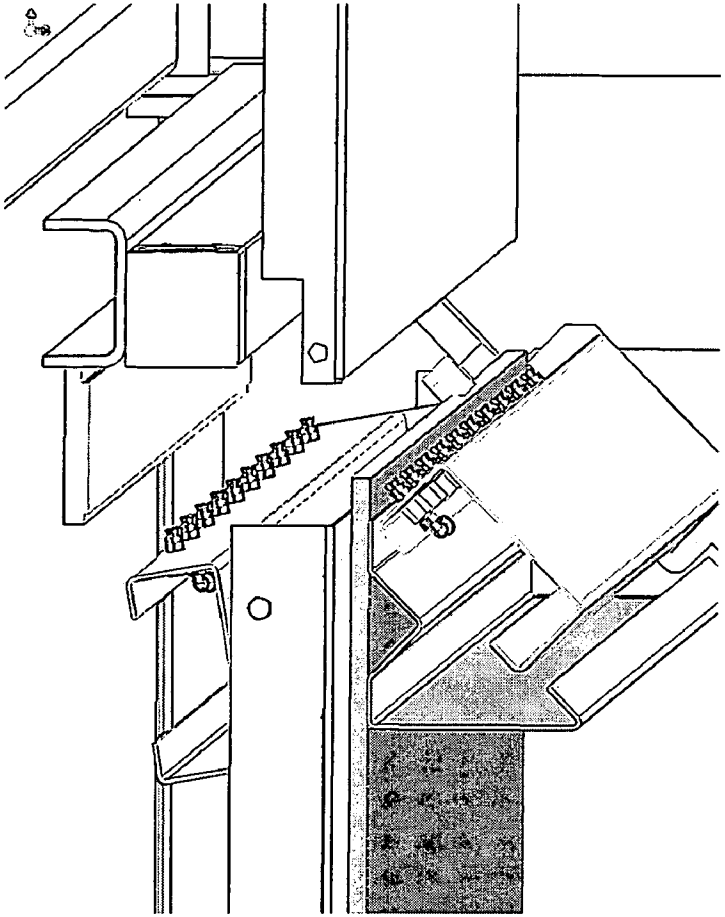
Figure 5I:
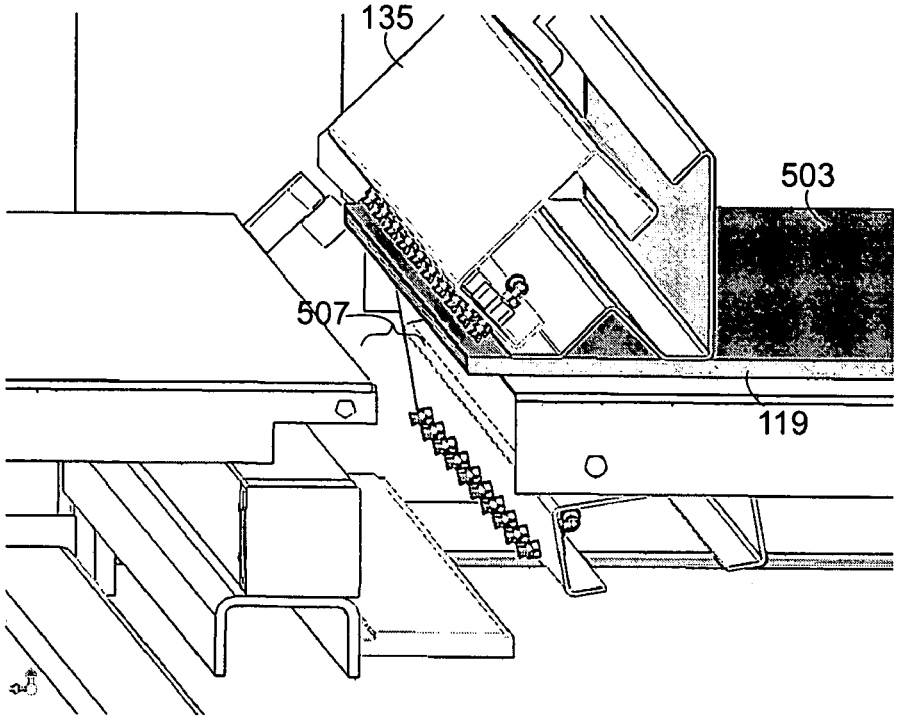
Figure 5J:
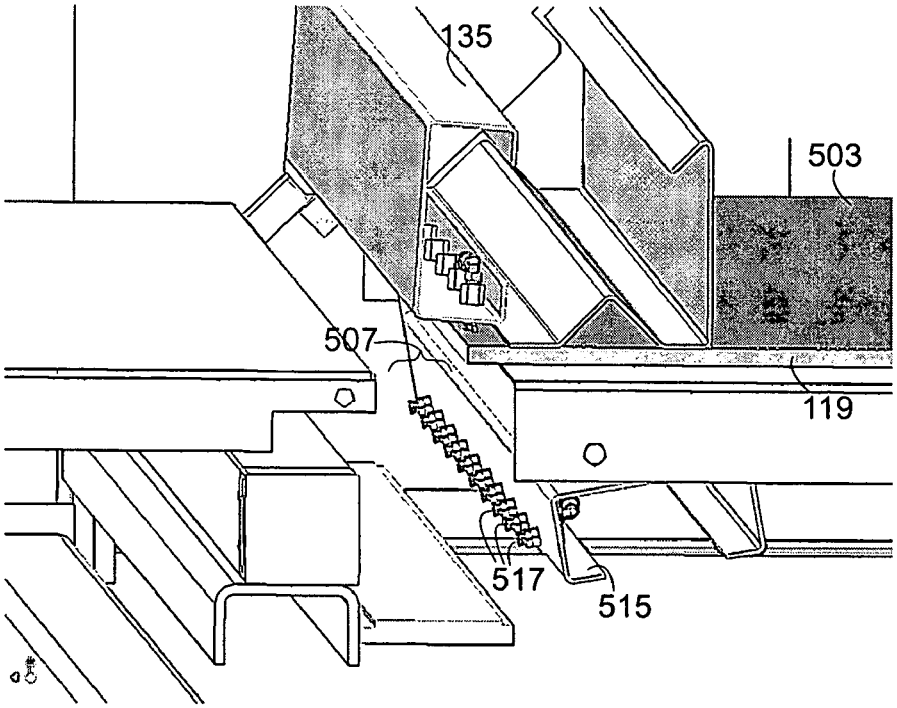
Figure 5K:
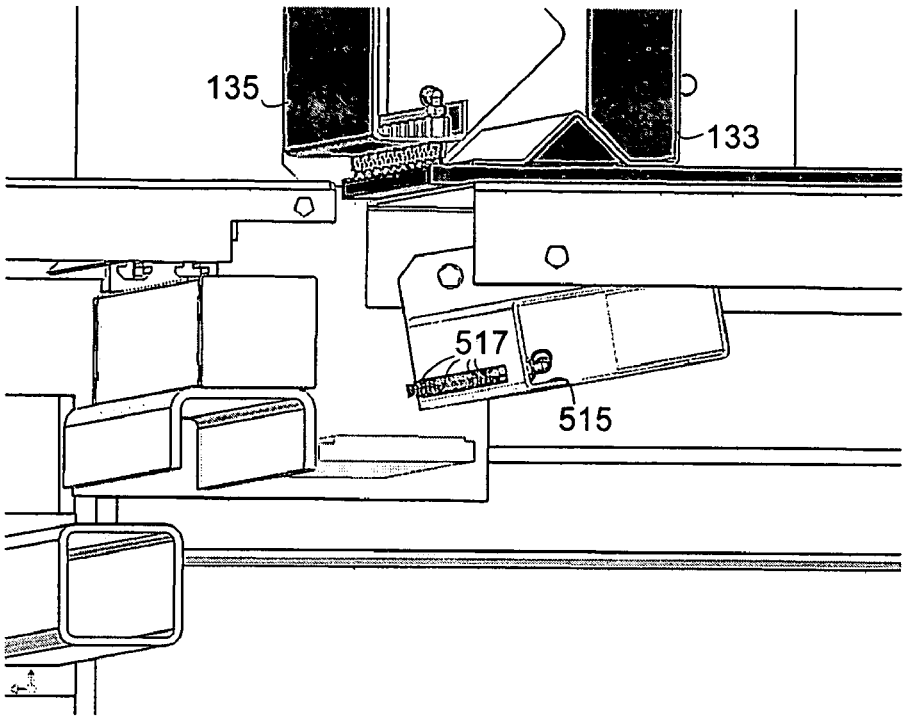
Figure 5L:
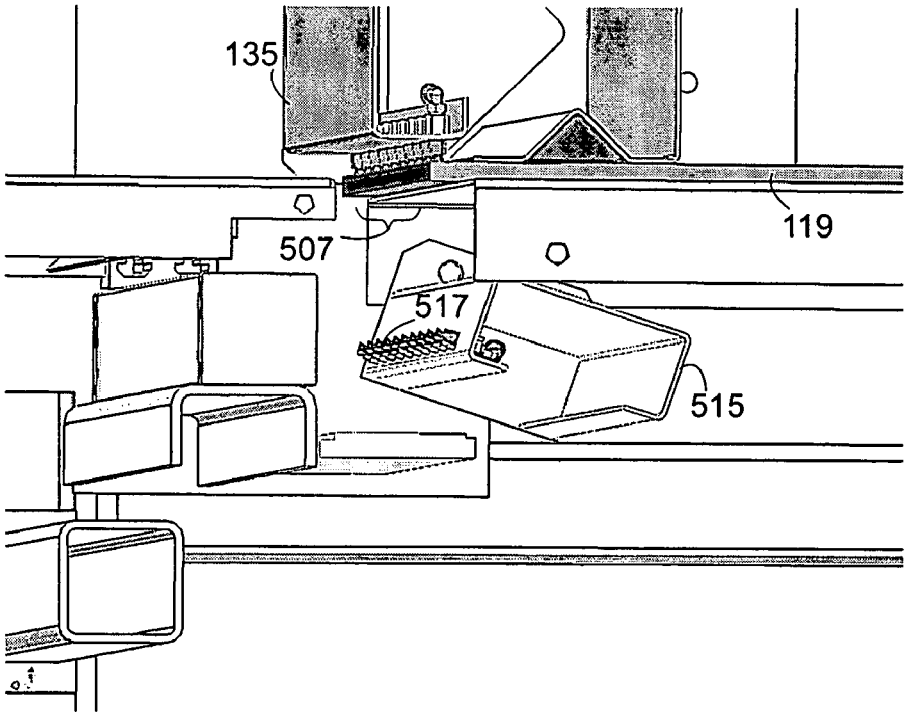
Figure 5M:
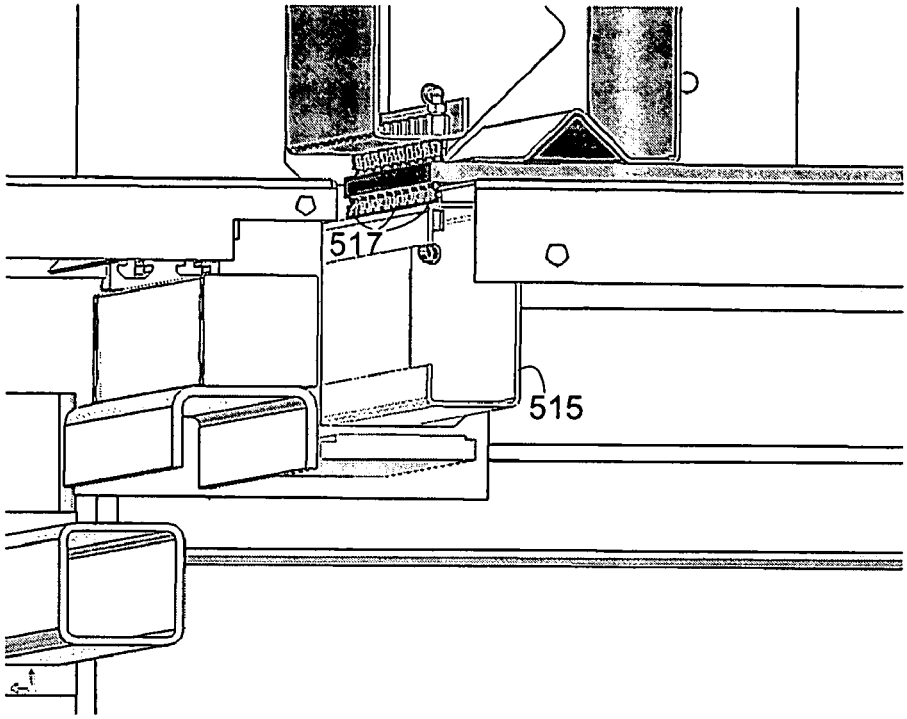
Figure 5N:
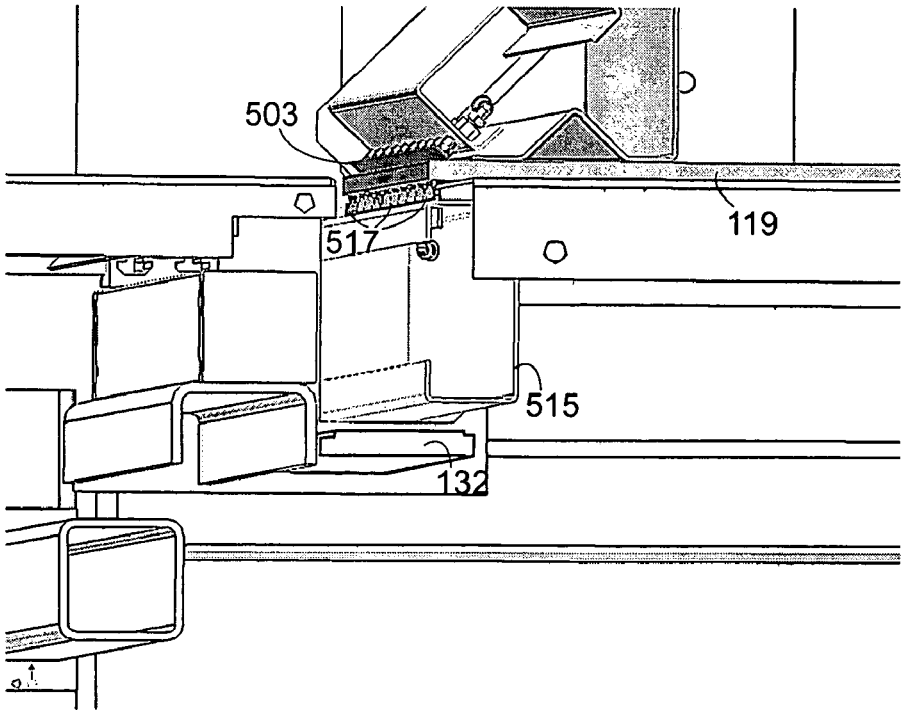
Figure 5O:
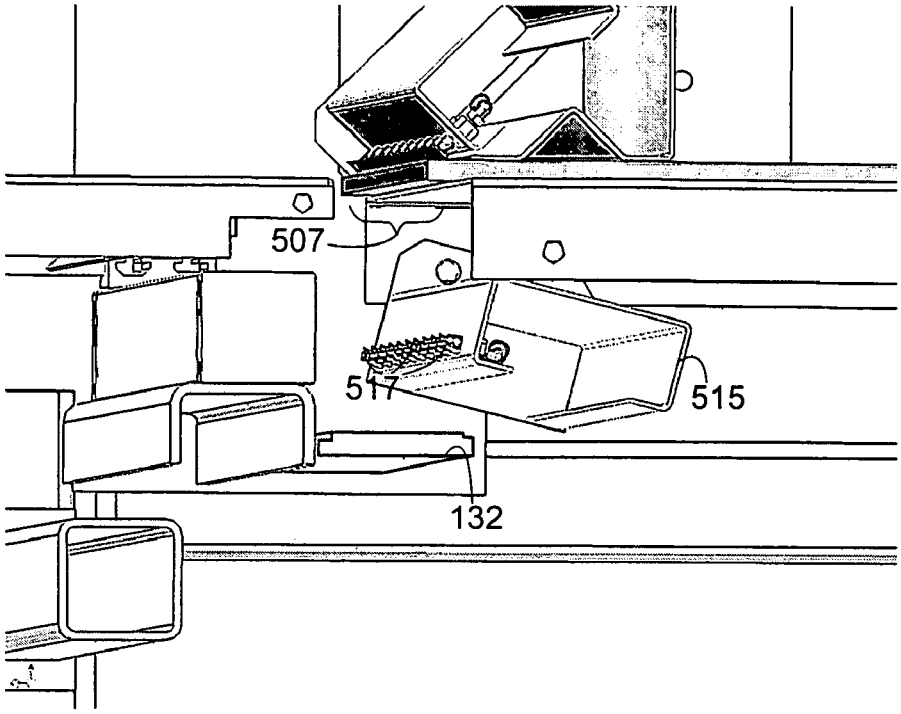
Figure 5P:
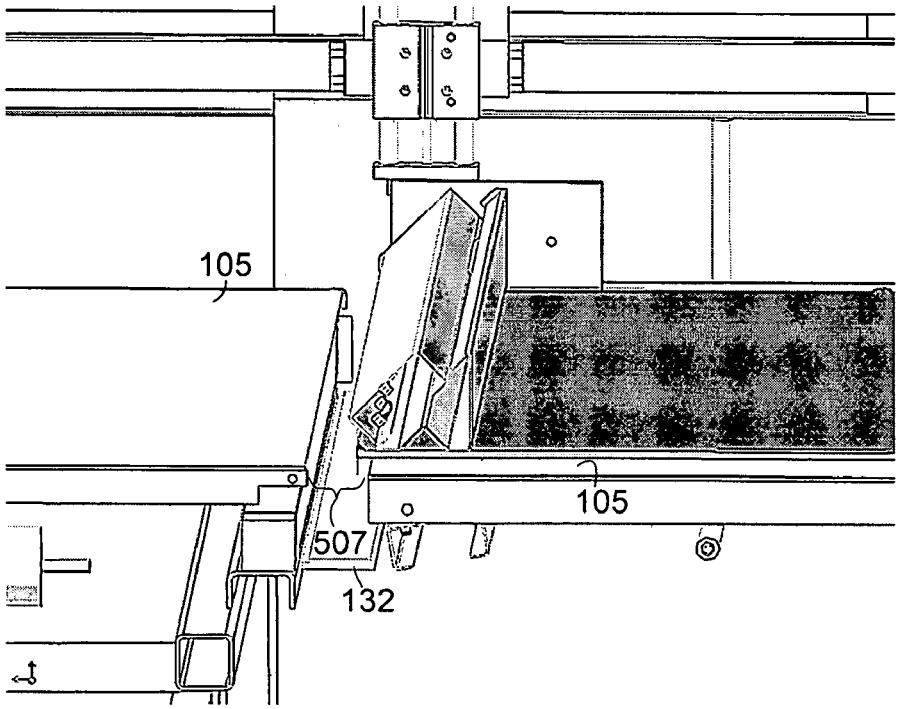
Figure 5Q:
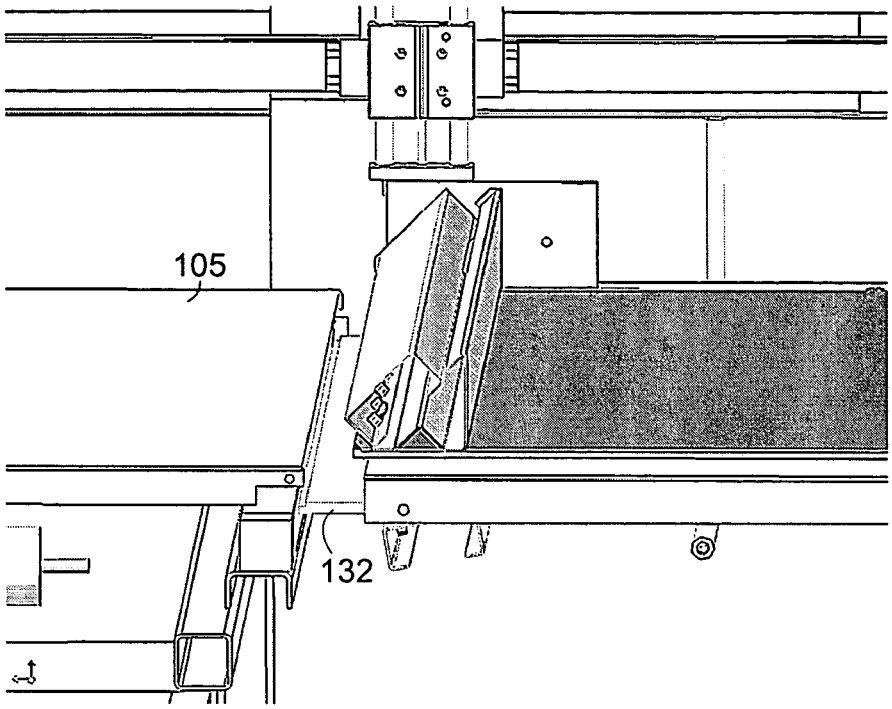
Figure 5R:
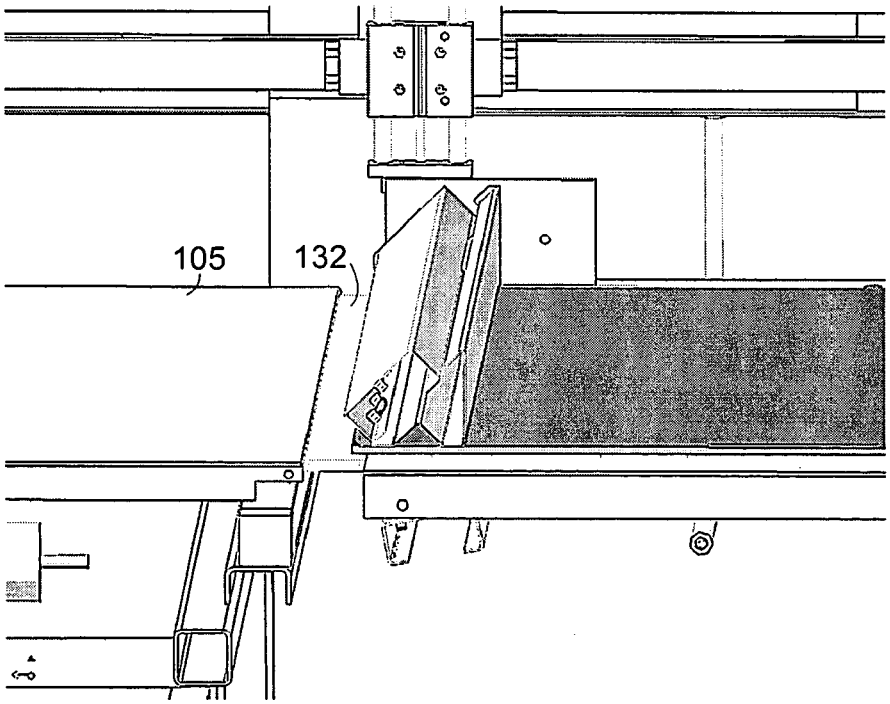
Figure 5S:
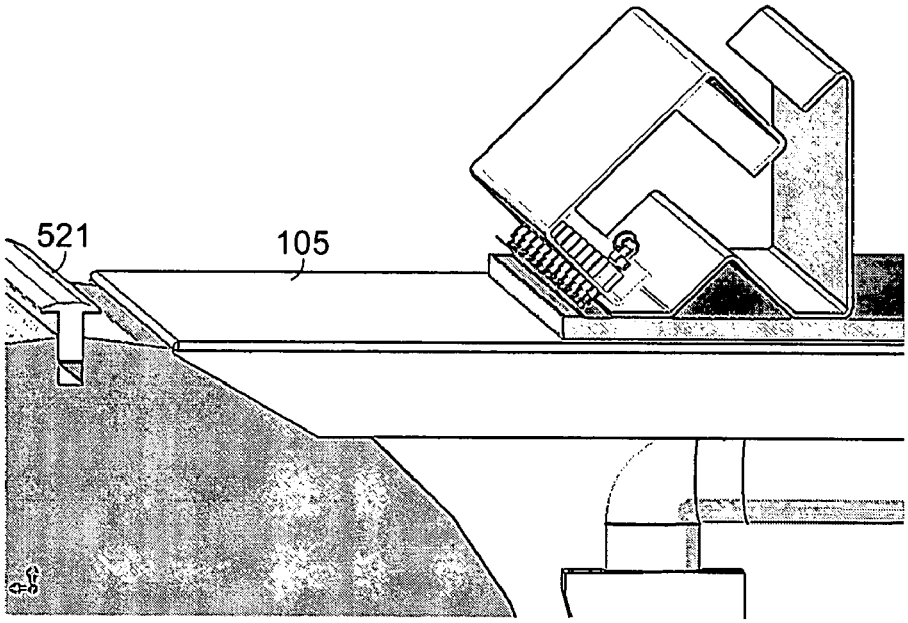
Figure 5T:
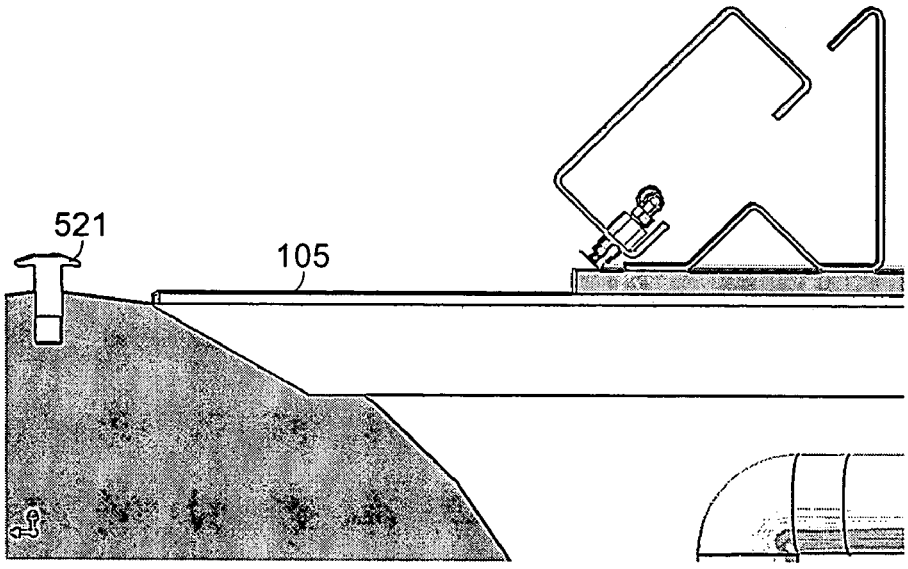
Figure 5U:
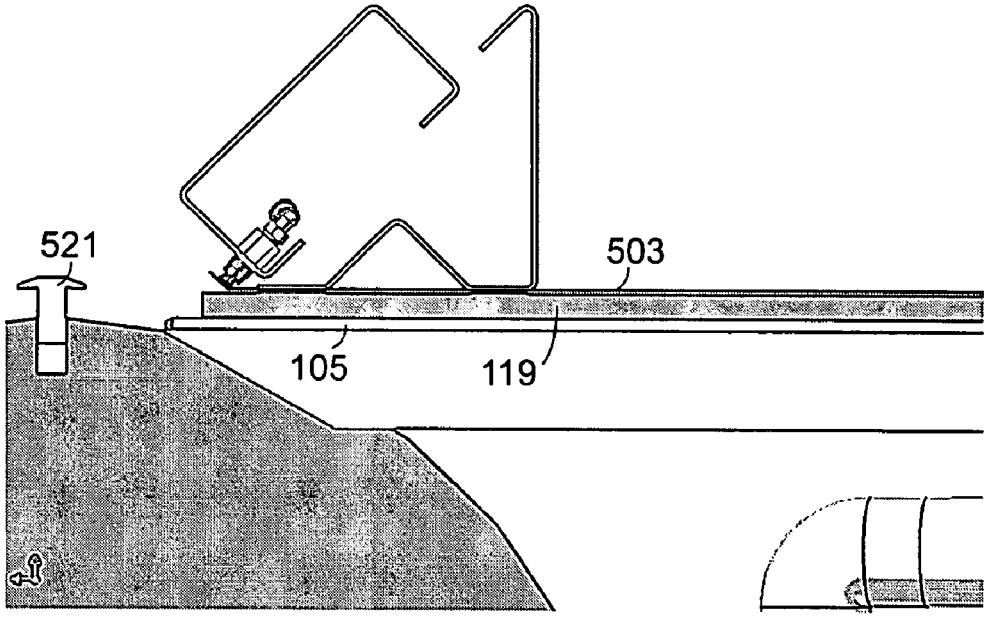
Figure 5V:
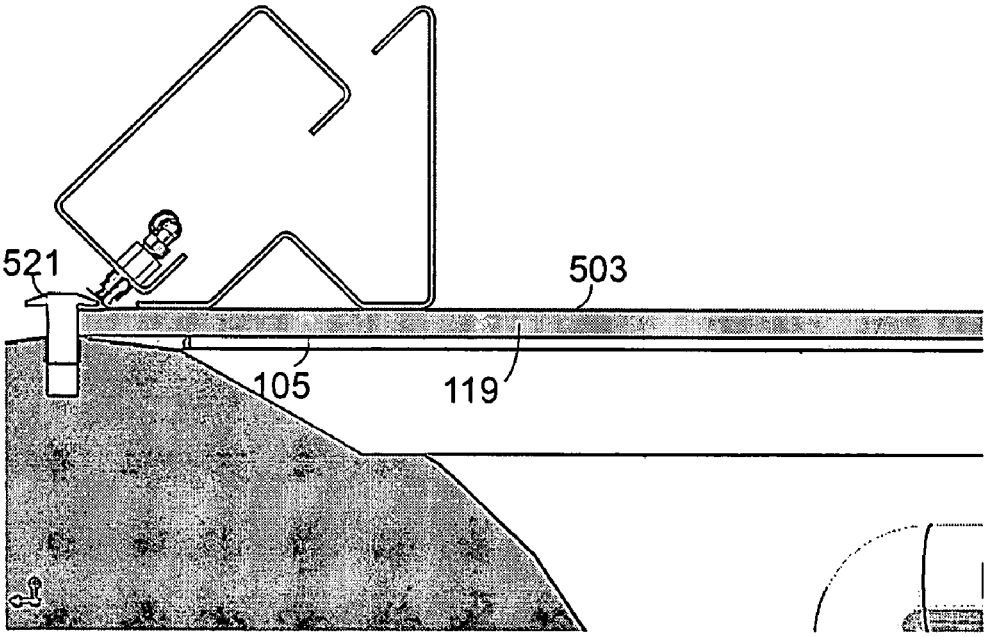
Figure 5W:
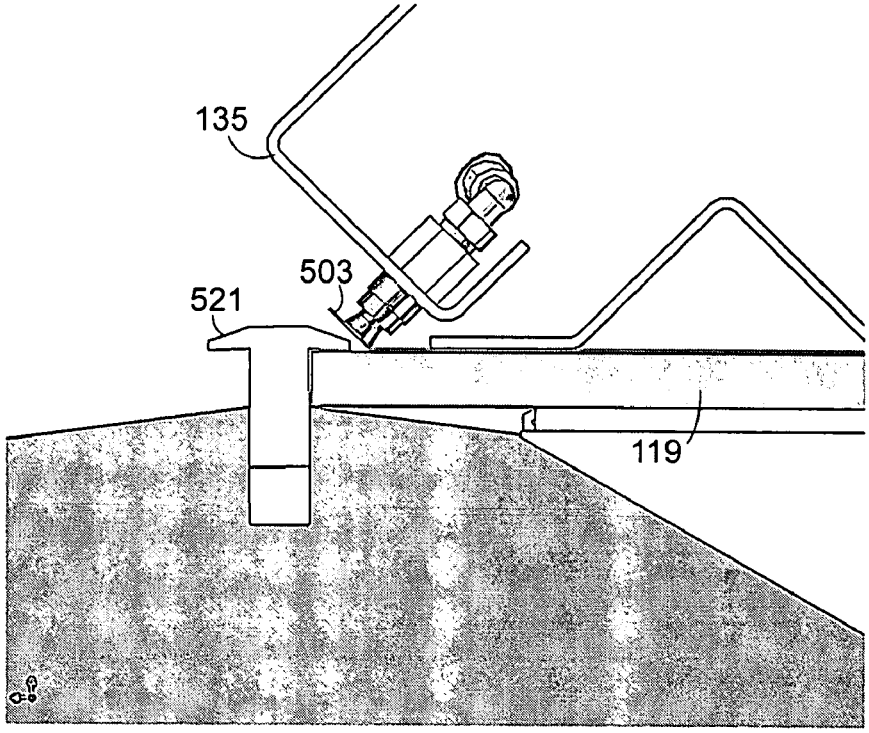
Figure 5X:
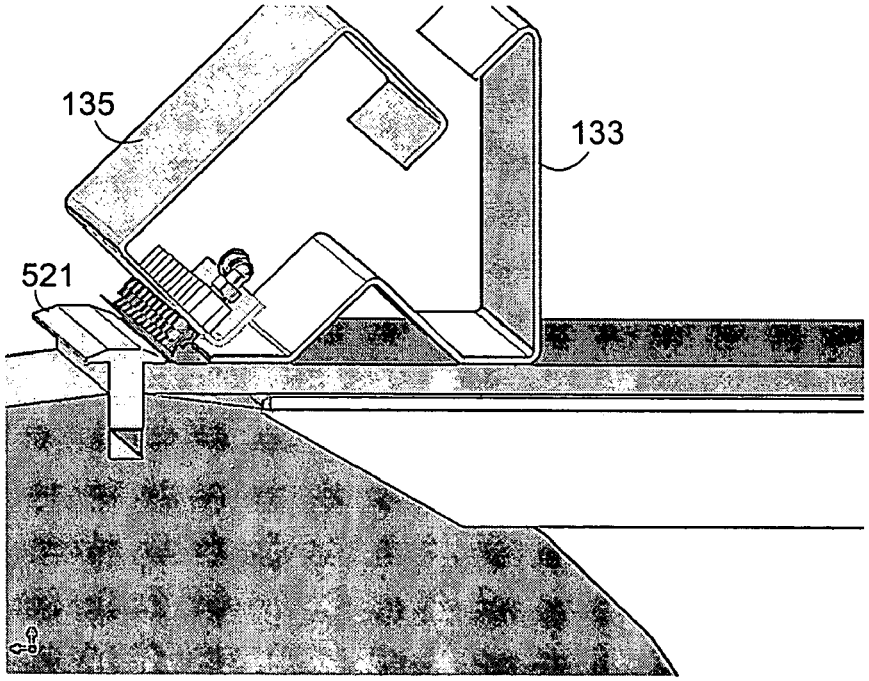
Figure 5Y:
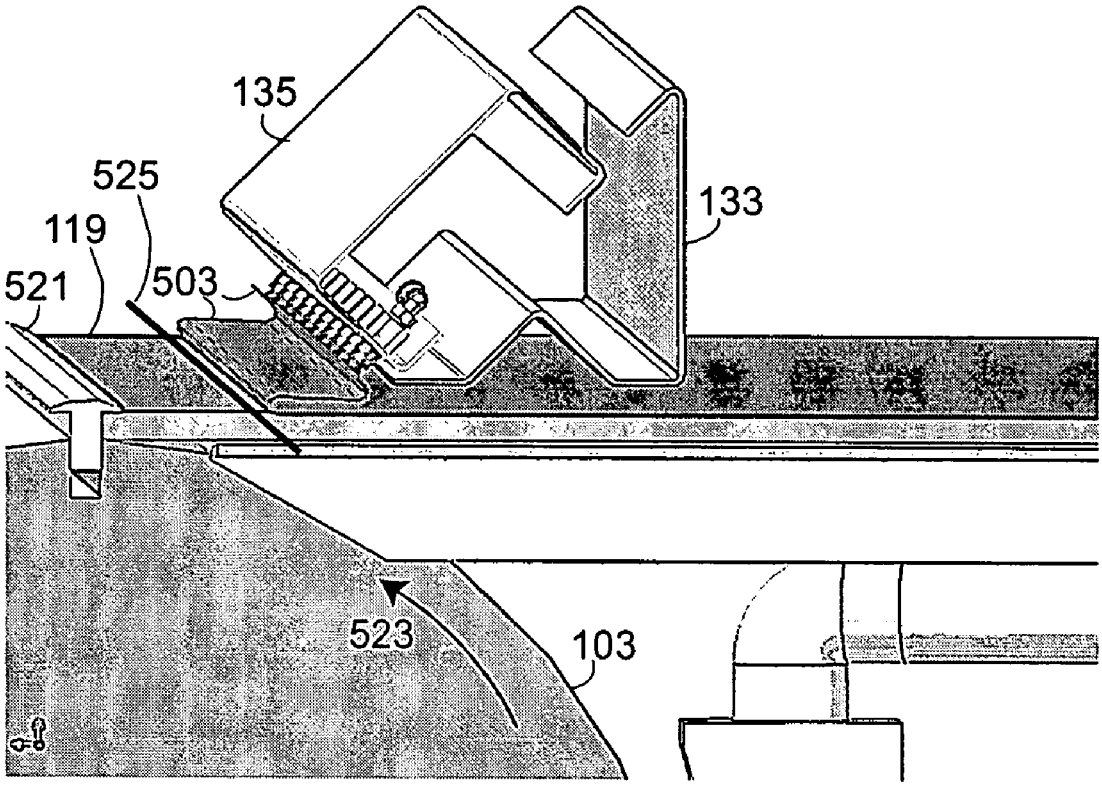

FIGS. 5A–5Y show the sequence of the automatic loading onto the drum aspect, and the automatic removal of the protective sheet aspects of the invention. These aspects are controlled under control of the control system 102.

FIG. 5A shows a first perspective view of a first mechanism 135 that includes a first set of suction cups gripping a plate 119 with a protective sheet 503 thereon. An adjacent section 133 maintains the combination of plate and protective sheet horizontal. The flexible pipes from the suction cups to an included source of vacuum are not shown so as not to obscure the views of how the automatic loader and protective sheet unloader operate. Only the bolts 505 of the first set of suction cups are shown. The movable part 132 of the loading area 105 is shown moved way to leave an opening 507 for the loading area 105.

Also shown is the bending device 509 that includes a roller 511. The bending device is movable across the width of the opening 507 back and forth in the direction shown by arrow 513.

FIG. 5B shows another perspective view that provides a better view of the bottom of the loading area 105 in the vicinity of the opening 507. This view shows a second mechanism 515 that includes a second set of suction cups—the suction cups have reference numeral 517 in FIG. 5B. The suction cups are connected to a vacuum source (not shown) via pipes, one of which is shown as pipe 519. The second mechanism is hinged at hinge 520 to rotate such that the suction cups may grab the bottom of the plate when the plate is over the opening 507 of the loading area 105.

FIG. 5C shows the view of FIG. 5B while the plate is being moved horizontally out of its cassette (e.g., cassette 113 not shown) while the cassette is in its vertical loading position and its horizontal loading position.

FIG. 5D shows the plate 119 with the protective sheet and sheet away at the location such that the edge of the plate and protective sheet is above the opening 507 formed by moving away panel 132.

When the plate is at the intermediate position over the opening 507, the first mechanism 135 lets go of the plat□e, i.e., the vacuum is shut off, and the mechanism 135 moves away from the plate, in particular rotates such that the edge of the plate may be bent away from the plane of the surface of loading area 105. FIG. 5E shows a perceptive view with the first mechanism 135 moved such that the end edge of the plate 119 and protective sheet 503 may be so bent.

The bending device 509 that in one embodiment includes a wheel 511 that rolls against the edge of the plate now moves back and forth across the plate edge in the direction 513. This bends approximately 10 mm of the end of the plate and protective sheet to an angle that is adjustable to between 30 and 90 degrees, depending on the plate type. The adjacent section 133 maintains the adjacent part of the plate and protective sheet horizontal during the bending. The bending device moves back and forth across the plate edge between one and three times depending on the plate type. The purpose of the bending by the bending device is to loosen the protective sheet from the plate at the edge region. Otherwise, the protective sheet tends to stick heavily to the LAMS coating.

FIGS. 5F, 5G, 5H, and 5I show this back and forth action. In one alternate implementation, the suction cups of the grabber hold the plate 119 and cover 503 during bending a distance away from the edge so that the plate cannot slip in the horizontal direction.

FIG. 5J shows that at this stage, the first mechanism 135 that includes the first set of suction cups arranged as a row moves onto the protective sheet 503 along the width in the strip area separated from the plate. FIG. 5K shows a different perspective view that shows the second mechanism 515 that includes the second set of suction cups 517 arranged as a row. At this stage, as shown in FIGS. 5L and 5M, the second mechanism 515 moves by rotation such that the second set of suction cups is under the edge of the plate 119 through the opening 507 in the loading area 105. The order of the moving is not important, i.e., whether the top protective sheet or the bottom of plate 119 is held first, as shown in the sequence of FIGS. 5J to 5M, or in a different order. Vacuum is applied to the first and second sets of vacuum holders.

The second set of suction cups maintains the plate at the horizontal surface, while the first mechanism 135 lifts, e.g., by tilting, to tilt the protective sheet 503 at the edge away from the plate 119. FIG. 5N shows the results of such moving of the protective sheet 503 away from the plate 119.

The vacuum to the bottom second set of suction cups 517 is removed, and the second mechanism 515 of the second set of suction cups is moved away. FIG. 5O shows the suction cups 517 of the second mechanism 517 so moved away.

FIGS. 5P, 5Q and 5R show the movable panel 132 now moving to close the opening 507 to form a substantially horizontal surface. The surface of area 105 is shown closed in FIG. 5R.

The grabbing mechanism 135 with the vacuum holders still holding the protective sheet now slides the plate 119 and protective sheet 503 towards the drum 103. Such movement is shown in FIGS. 5S, 5T, 5U and 5V.

A clamping mechanism, in one embodiment a T-clamp, is open during the motion shown in FIGS. FIGS. 5S, 5T, and 5U and the plate is moved until the plate edge is under the T-clamp 521 as shown in FIG. 5V. The T-clamp 521 now closes to grip the plate 119 without also gripping the protective sheet 503 because of the sheet's being held separated from the plate 119 at the plate edge by the first set of suction cups. FIG. 5W shows a cross-sectional view of the clamp 521 holding the plate 119 at the plate edge. FIG. 5X shows a perspective view of this stage of operation.

Once the plate edge is clamped to the drum, two actions occur. The first action is that the first mechanism 135 moves horizontally back to its horizontal rest position close to being over the movable part 132. The first set of suction cups of the first mechanism 135 maintains hold on to the protective sheet 503 such that the sheet 503 is partially peeled away from the plate. The movement away from the clamp 521 is shown in FIG. 5Y.

The second motion is that the drum rotates, e.g., in the direction 523 shown in FIG. 5Y. The rotation of the drum with the plate clamped thereon while the first set of suction cups still holds on to the protective sheet further removes the protective sheet 503 from the top of the plate 119, while the plate 119 is loaded on to the drum 103.

An anti-static device 525 in the form of a wire across width of the device is turned on during the motion to emit ionized air, and in particular, ionized air that can reach the separation region between the plate and separated protective sheet and thus remove any static electricity built up, so that the removal is easier. Note that, as would be known to those in the art, the source of electric supply to the wire is not shown, nor are the mechanical supports. Note also that in an improved embodiment, one or more blowers are included to ensure that the ionized air reaches the region between the plate and separated protective sheet.

The first and second motion is coordinated. In one embodiment, the backwards movement of the gripper/first mechanism 135 occurs simultaneously with the rotation of the drum.

The protective sheet is now transported to a trash compartment.

Note that FIGS. 5A–5Y do not show any many details, such as the mechanical supports for the first and second mechanisms, nor the motors that cause the actions to take place under control of the control system. The particular designs are now shown so as not to obscure the operation of the devices. Those in the art will find including such mechanisms straightforward from the description provided herein.

Note further that in one embodiment, to ensure that the plate is positioned substantially parallel to the T-clamp on the drum after being taken out of its compartment, a plurality of mechanical blocks are included on the grabber mechanism 135 parallel to the T-clamp direction. This ensures that when the plate is moved onto the area 105 plane by the grabber mechanism 135, its front edge is substantially parallel to the clamp.

In an alternate embodiment, the compartment once at its loading vertical position is moved to an intermediate horizontal position prior to being moved to its loading horizontal position. At the intermediate horizontal position, there is a gap between the imager and the magazine, and such gap is used to provide access to the bottom of the plate opposite the side whereon a protective sheet lays. An automatic plate mover automatically moves the plate horizontally from the compartment at the intermediate position to provide such access to the bottom of the plate. At the intermediate position, the plate is restrained on such bottom side, and while restrained, any protective sheet on the plate is partially lifted and held. The compartment and plate are now further moved horizontally to the loading horizontal position, and then the plate is further moved to an imager loading horizontal position, then onto the imager while the protective sheet is held. As the plate is loaded onto the imager, the holding of the protective sheet removes the protective sheet from the plate, such that the plate is loaded onto the imager without the protective sheet.

Figure 6:
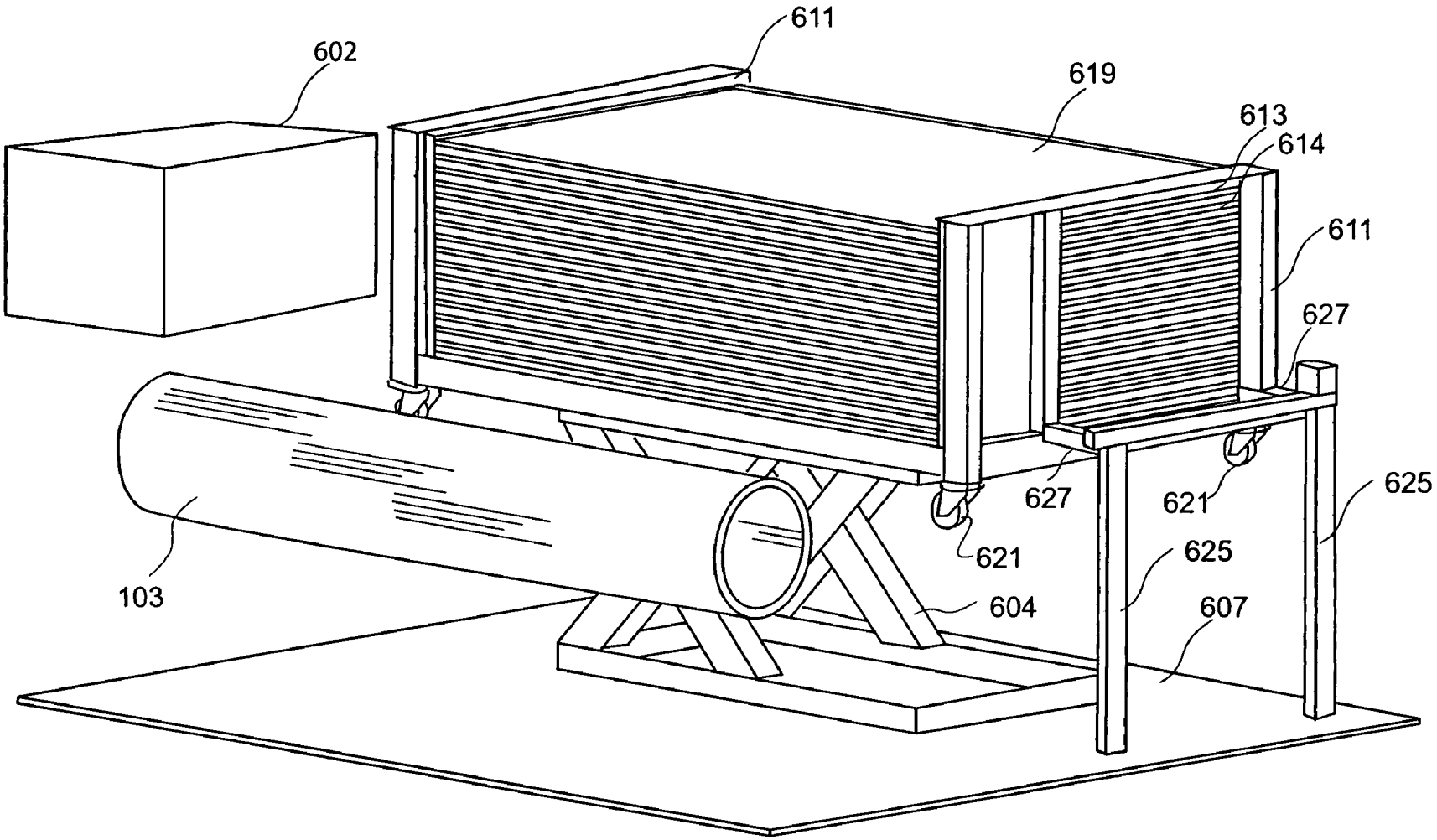
FIG. 6 shows in simplified form an alternate embodiment of a CTP flexographic plate loading and unloading system.

FIG. 6 shows another embodiment in simplified form. Only the drum 103 of the imager 101 is shown so that the operation of the loader is clear. The automatic removal of the protective sheet and the automatic loading from the cassette onto the drum, as described above and shown in FIGS. 5A–5Y, also are not shown.

A loader includes a magazine that includes a frame 611. The magazine includes a set of compartments 613, 614, . . . , each able to contain a single CTP flexographic plate and each compartment horizontally movable. One plate is shown as plate 619 in the top compartment 613. One embodiment contains at least 10 compartments, e.g., in the order of 20 compartments. The magazine's frame has wheels 621 so is transportable, e.g., from a storage location to a loading location and from the loading location to a processing location. The magazine is dockable to the loading location that is disposed relative to the imager (not shown) so that a compartment at a vertical position called the loading vertical position can be horizontally moved to and from a horizontal position called the loading horizontal position, in one embodiment in a loading area 105 in the imager (see FIG. 1). The imager 101 and a set of docking posts 625 are attached to a base 607 such that the docking posts 625 are located a certain distance from the imager selected to that any compartment at the loading vertical position can be horizontally moved to the loading horizontal position. The magazine docks onto the docking posts 625 via docking sections 627 that fit within grooves in docking posts 625 and that can slide in the grooves while the magazine is moved up and down using a lifting mechanism 604. The docking posts 625 thus provide a guiding mechanism for the lifting mechanism 604 that moves the magazine containing the compartments up or down under control of a control system 602. The guiding mechanism maintains the compartments in the magazine in a fixed horizontal position during the up and down motion.

The control system 602 also controls the automatic loading of the plate onto the drum, and the automatic removal of the protective sheet.

Figure 7:
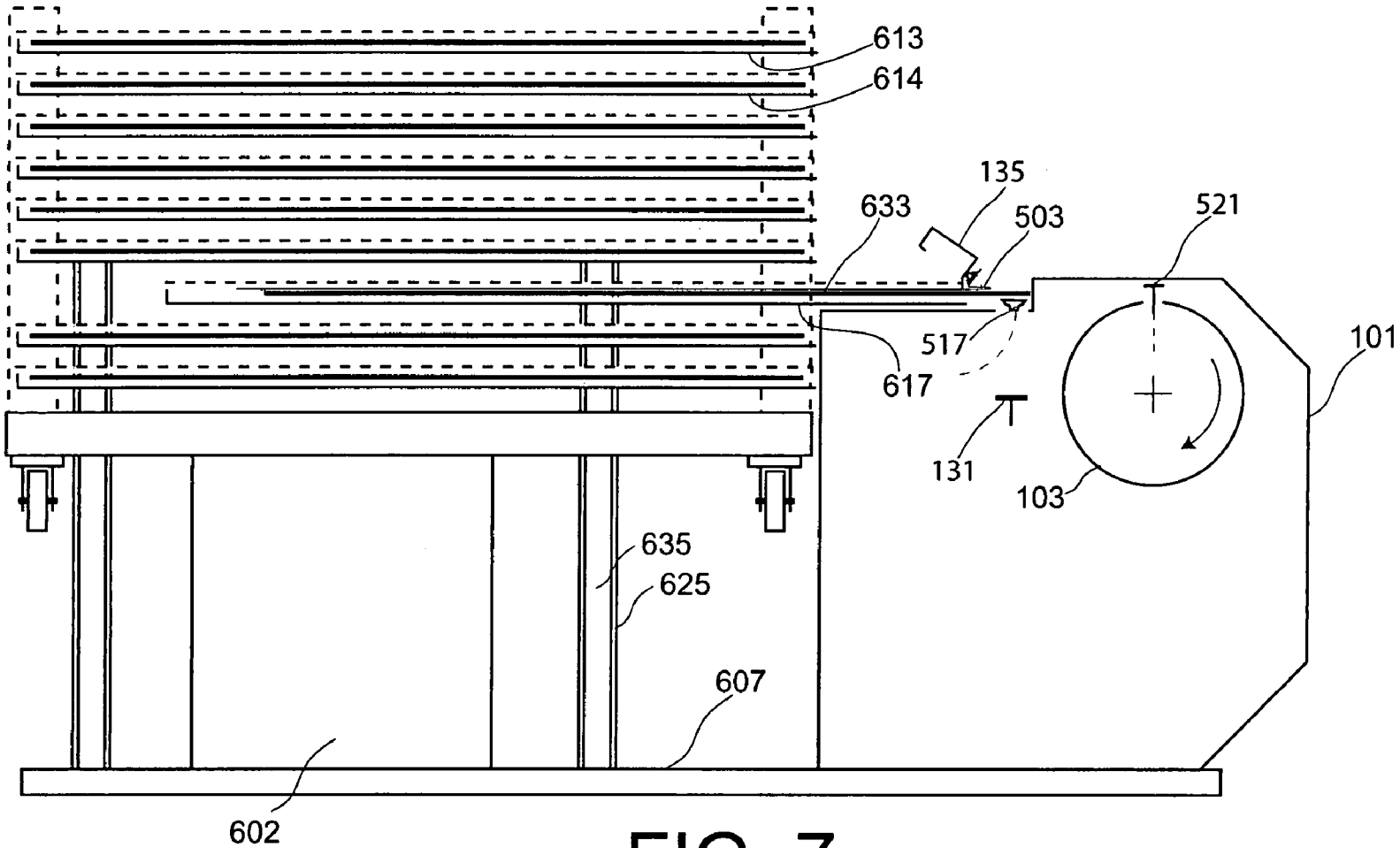
FIG. 7 shows a simplified side view of the magazine and imager according to one embodiment of the invention.

FIG. 7 shows a simplified side view of the magazine and imager 101. This cross-sectional view includes some aspects of the automatic protective sheet removal and the automatic loading from the cassette to the drum. When the frame 611 supporting the magazine of compartments is at the docked position, the control system 602 is designed to move the magazine using the lifting mechanism 604 such that a selected compartment is at the loading vertical position adjacent to the loading area 105 of the imager 101. The docking posts 625 include a groove 635 and provides a guiding mechanism for the docking section 627 to aid in guiding the magazine during its up or down motion. When the selected compartment, shown as compartment 617 is at its loading vertical position, the compartment is horizontally movable back and forth from the rest horizontal position to a loading horizontal position flush with a loading area 105. Then the selected compartment is at the loading horizontal position, in a manual version, an operator moves the flexographic plate 633 in the compartment and attaches it to the drum 103, in one embodiment using a T-clamping mechanism on the drum shown as 521 in FIG. 7. In a preferred embodiment, an automatic plate loader removes the plate from the compartment and onto the clamping mechanism, and further, starts the removal of any protective sheet that is on top of the plate. These automatic loading and protective sheet removal aspects are as described above. In wither the manual or the automatic loading case, the unimaged flexographic plate is now wrapped around the drum, and the door 107 (not shown in FIG. 7) is closed. The plate is now imaged. After imaging, the imager's door is opened, the imaged plate is unwrapped and unclamped and moved back onto the compartment 617. In the manual version, this is done by the operator, while in the automatic version, it is carried out by the reverse of the operations described above with the help of FIGS. 5A–5Y. The compartment now is moved from the loading horizontal position to the rest horizontal position and the magazine moved under control of the control system 602 until another desired compartment is at its loading vertical position so that it can be horizontally moved to the loading horizontal position.

Figure 8:
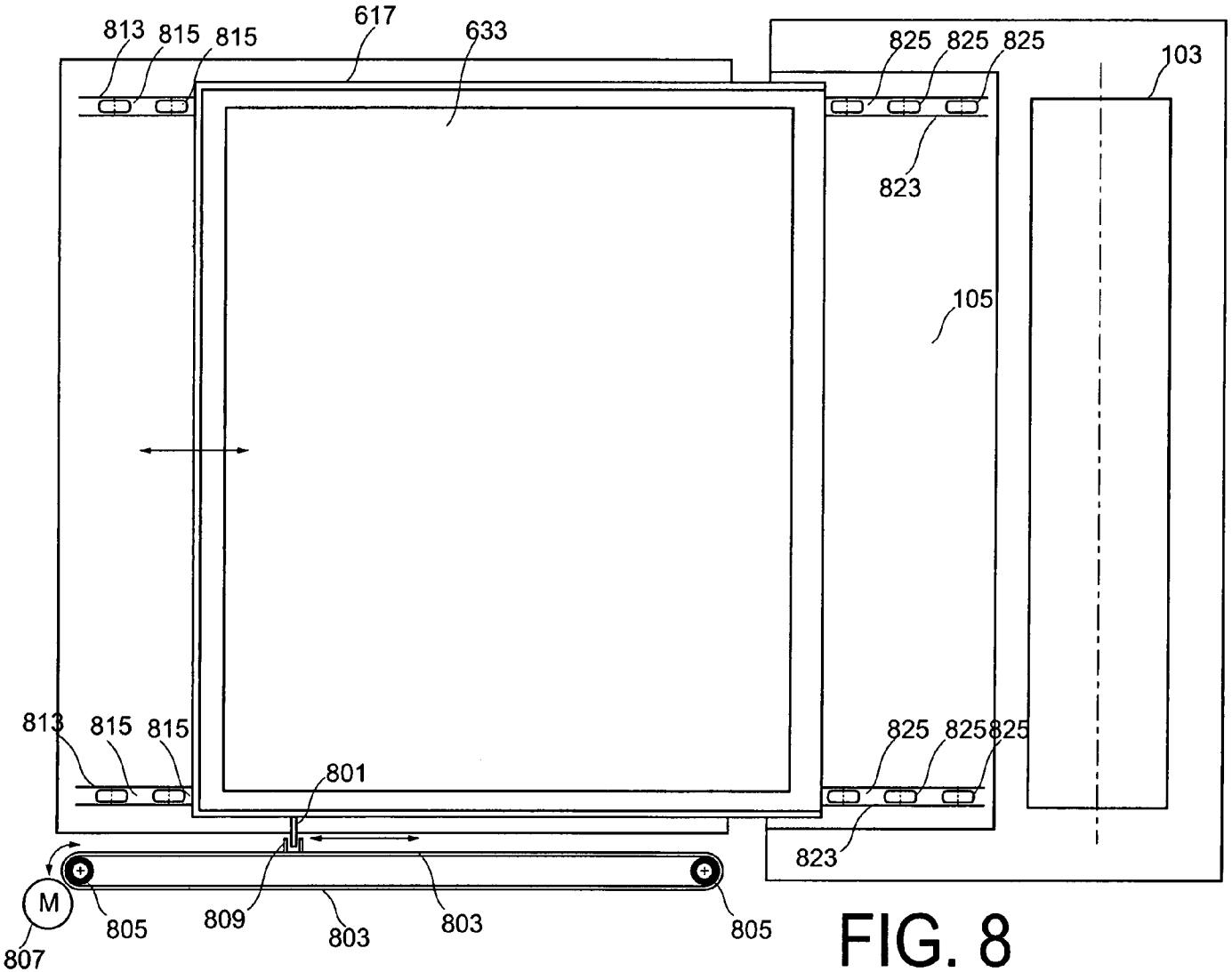
FIG. 8 shows a simplified top view showing one of the compartments in horizontal motion between the rest horizontal position and the loading horizontal position to illustrate one embodiment of the horizontal movement mechanism.

The motor driven horizontal movement mechanism is now described in more detail. FIG. 8 shows a simplified top view showing one of the compartments in horizontal motion between the rest horizontal position and the loading horizontal position. FIG. 8 will be explained for the embodiment shown in FIGS. 6 and 7, and is equally applicable to the embodiment shown in FIGS. 1 and 4A–4J. The horizontal movement mechanism includes a chain drive system having a pair of rotatable sprockets 805 mechanically coupled to cooperate with a chain 803 and transmit rotary motion of the sprockets 805 into linear motion of the chains 803. A motor 807 rotates the sprockets 805 under control of the control system 602. The compartment includes a pin 801 located such that when the compartment is at the rest horizontal position and moved to the loading vertical position, the pin sits in a U-shaped brace 809 that is attached to the chain 803 so that when the sprockets rotate, the U shaped brace and thus the compartment moves horizontally from the rest horizontal position to the loading horizontal position.

In one embodiment, the motor that causes the sprockets 805 to rotate is located near the sprockets at approximately the loading vertical height. In an alternate embodiment, the motor is located at the bottom of the frame and transmits rotary energy to the sprockets 805 by driving a drive shaft coupled to the sprockets 805 via gear boxes and couplings.

In one embodiment, the horizontal movement of the compartment to and from the loading horizontal position is aided by a set of wheels or rollers 815 in a set of supports, e.g., set of rails 813 that are attached to the frame of the magazine. In one embodiment, the wheels 815 and supports 813 are located underneath the compartments so that the compartment rolls on top of the wheels 815 when it is moved horizontally.

It should be noted that the drawings are not to scale. In particular, in one embodiment, when the plate is at the horizontal loading position, the majority of the compartment is away from the frame of the magazine, up to 80% in one version. To support the horizontal motion of the part that is outside the frame, in one embodiment, the loading area 105 of the imager includes a set of a set of wheels or rollers 825 in a set of supports, e.g., set of rails 823 located such that part of the compartment can roll on top of the wheels when the compartment part is on top of area 105.

Figure 9:
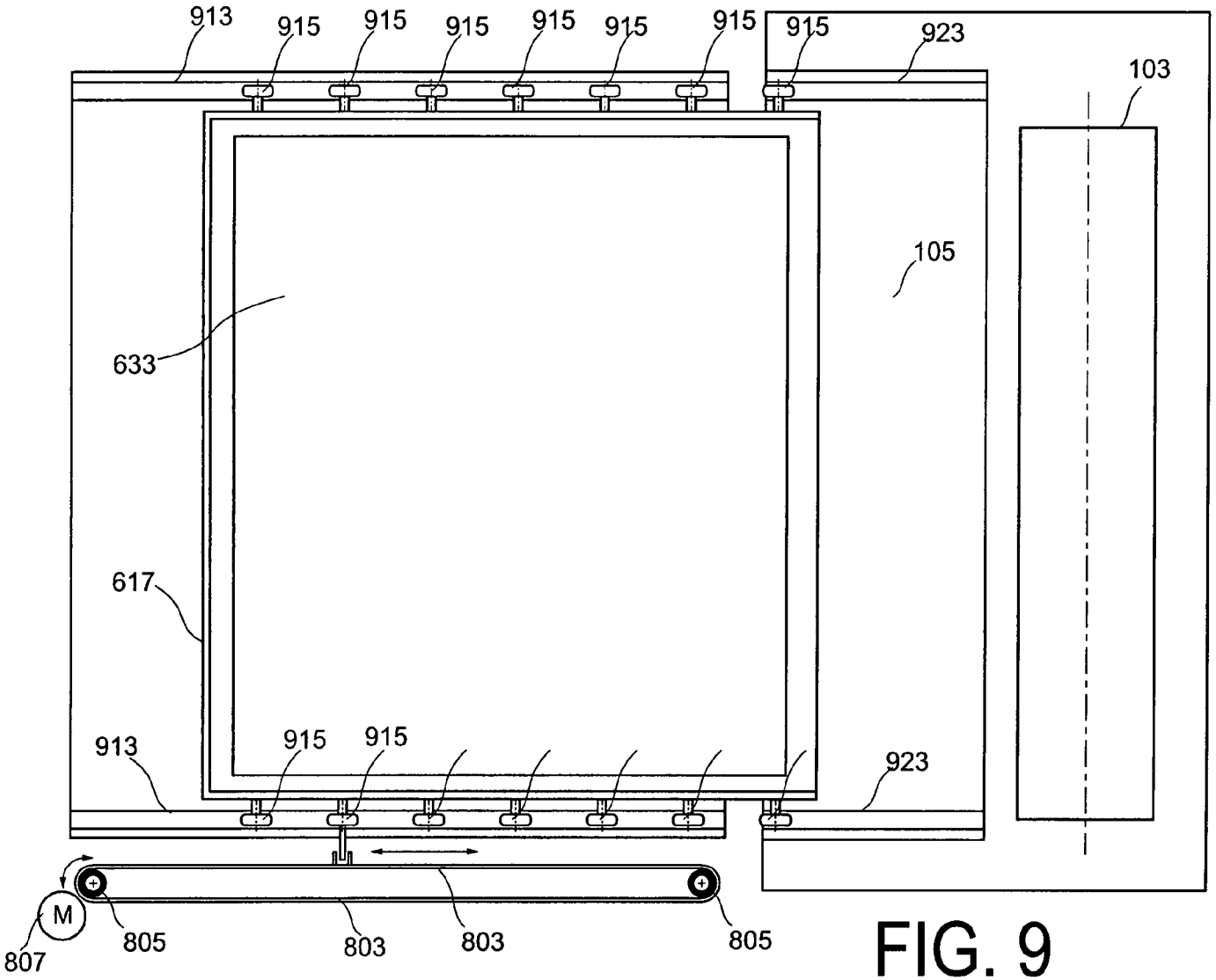
FIG. 9 shows a top view of an alternate embodiment of rollers that provide for horizontal motion using an embodiment of a horizontal movement mechanism.

FIG. 9 shows an alternate embodiment of the wheels that provide ease of horizontal movement of the compartment that is at the loading vertical position. The compartment has a set of guide rollers or wheels 915 attached to each side. The guide rollers 915 are in support rails 913 that are attached to the frame such that the compartment is movable horizontally when it is at the loading vertical position. In one embodiment, a further set of support rails 923 are provided at the load area 105 of the imager 101 such that when the compartment is moved from the rest horizontal position to the loading horizontal position, the further set of support rails 923 provide support of the rollers 915 of that part of the compartment that is over the load area 105.

The automatic loading onto the drum, and the automatic protective sheet removal are not shown in FIG. 9.

The lifting mechanisms are now described in more detail. For the embodiment of FIGS. 6 and 7, the lifting mechanism is an hydraulic lift that lifts the complete magazine of compartments under control of the control system 602 until a desired compartment is at the vertical loading position.

Figure 10:
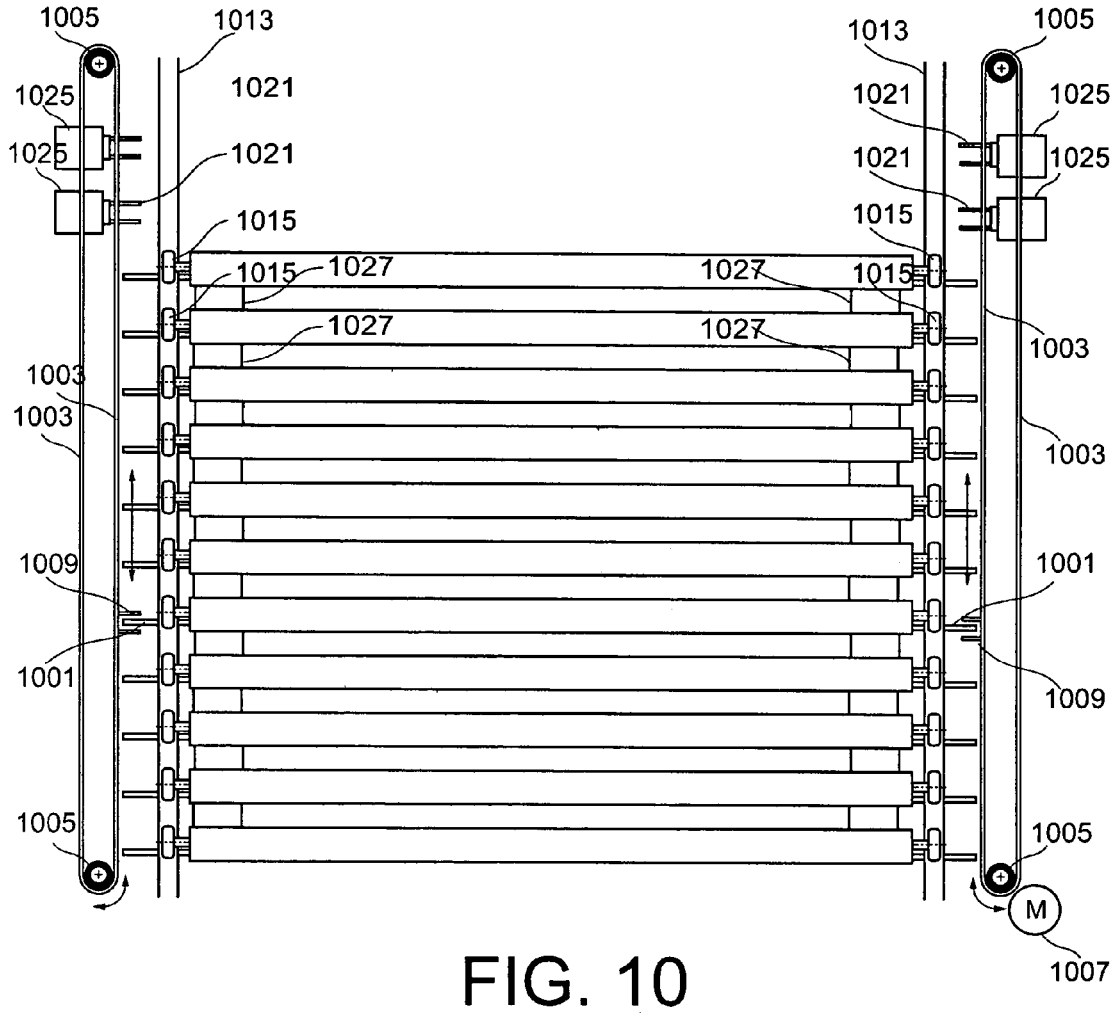
FIG. 10 shows a simplified view of an embodiment of a lifting mechanism suitable for use in the embodiment shown in FIG. 1.

For the embodiments of FIGS. 1 and 4A–4J, FIG. 10 shows a simplified rear view that explains how one embodiment of the lifting mechanism is constructed and functions under control of the control system 102. The support frame 111 includes four vertical support beams provided with guide tracks 1013 for guiding each compartment while the compartment is vertically moved. Only two such guide tracks are shown in FIG. 10. Each compartment has four rotatable guide wheels 1015 (only two shown per compartment in the view of FIG. 10) that ride in the guide tracks 1013 at the corners of each compartment. One embodiment of the lifting mechanism includes a pair of chain drive systems each having a pair of rotatable sprockets 1005 mechanically coupled to cooperate with a chain 1003 and transmit rotary motion of the sprockets 1005 into linear vertical motion of the chains 1003. A motor 1007 rotates the sprockets 1005 under control of the control system 102.

Each compartment includes a pair of outwardly pointing horizontal pins 1001 located perpendicular to the direction of horizontal motion. Each chain includes a U-shaped brace 1009 that can engage and disengage from a pin (the "engaged" and "unengaged" positions, respectively) when the U-shaped brace is adjacent to the compartment. In one embodiment, the U-shaped braces 1009 are rotatable in a horizontal plane between the engaged and unengaged position to respectively engage the pins or not engage the pins of a particular compartment under control of the control system 102. Consider a particular compartment. The U-shaped brace 1009 is initially unengaged. When the compartment is in the rest horizontal position, the motor 1007 causes the chains to move until the unengaged U-shaped braces 1009 are at a height next to the pins 1001 of the selected compartment. The selected compartment may now be moved by the braces 1009 moving to the engaged position and the motor causing the chain to move the brace that in turn moves the selected compartment until the compartment is at the desired loading vertical position.

In one embodiment, each compartment has a vertical imaged position which is on the top of the magazine. The magazine includes a locking mechanism to lock a compartment in its imaged vertical position. In one embodiment, the locking mechanism includes U-shaped braces 1021 attached to the frame by members 1025. The braces have an engaged position whereby a corresponding compartment is locked, and an unengaged position. In one embodiment, the engaging and unengaging is by rotating the U-shaped brace so that when engaged, a brace holds the pin 1001 of its respective compartment to lock the compartment at the imaged vertical position. The braces for only two imaged vertical positions are shown in FIG. 10.

In one embodiment, spacers 1027 between the compartments ensure that any compartments above the selected compartment that are not locked in their respective imaged vertical positions are also moved up and down when the selected compartment is moved up or down.

In one embodiment that uses rails and wheels on the compartments as shown in FIG. 9, the wheels 1015 are the end wheels of the wheels 915 shown in FIG. 9. The rails 1013 include slots at the loading vertical position to enable the horizontal rails to pass through, and similarly horizontal rails 913 are such that the end wheels that also from wheels 1013 can travel vertically.

Alternate lifting mechanisms suitable for adapting to be incorporated into the embodiments of FIG. 1 available in the prior art. Similarly, alternate designs for a lifting mechanism suitable for moving the magazine in frame 611 (FIG. 6) up and down are readily available and would be clear to those in the art.

Thus, a loading/unloading apparatus and method have been described suitable for CTP flexographic plates. One version includes manual loading of individual plates onto the rum, while another version includes automatic loading onto the drum. Furthermore, one version that includes the automatic loading onto the drum also includes automatic removal o the protective cover sheet that protects the surface of an un-imaged plate.

The apparatus improves the efficiency of workflows wherein a single plate is transported from a storage location to an imaging location adjacent to an imager, imaged, and then moved to a processing location. Furthermore, flexographic jobs typically need a plurality of sizes and plate types, e.g., plates of different hardness and/or thickness. An advantage of the inventive method and apparatus using a plate magazine providing one compartment for each plate can satisfy this need.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

All publications, patents, and patent applications cited herein are hereby incorporated by reference.

Thus, while there have been described what are believed to be preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

What is claimed is:

1. An apparatus to aid the loading and unloading of flexographic plates to and from an imager, the apparatus comprising:

a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager;

a lifting mechanism to lift and lower the compartments; and a control system to control the lifting and lowering by the lifting mechanism, such that a particular compartment is moved from its rest vertical position at the rest horizontal position to the loading vertical position at which the particular compartment is at the height for loading onto the imager or unloading from the imager, and when the particular compartment is at its loading vertical position, the particular compartment is movable horizontally from and to the rest horizontal position to and from a loading horizontal position suitable for loading and unloading the plate on the compartment onto and from the imager, the apparatus further comprising:

an automatic plate loader to remove the plate from the particular compartment and load the plate onto the imager wherein the automatic plate loader is configured to partially remove the plate from the particular compartment prior to the plate being moved to a plate's loading horizontal position.

2. An apparatus as recited in claim 1, wherein the automatic plate loader completes removing of the plate from the particular compartment at the plate's loading horizontal position.

3. An apparatus as recited in claim 1, wherein each compartment is for a single flexographic plate that may be covered by a protective sheet, and wherein the automatic plate loader includes an automatic protective sheet remover to remove the protective sheet when such a sheet is included on the plate, the removing prior to or during the loading of the plate onto the imager.

4. An apparatus as recited in claim 1, wherein the lifting mechanism is operative to lift and lower the magazine of compartments, and wherein the control system controls the lifting and lowering of the magazine until a selected one of the compartments is at its loading vertical position.

5. An apparatus as recited in claim 1, wherein the lifting mechanism is operative to lift and lower the compartments of the magazine one compartment at a time.

6. An apparatus as recited in claim 1, wherein the magazine comprises at least 10 compartments.

7. An apparatus to aid the loading and unloading of flexographic plates to and from an imager, the apparatus comprising:

a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager;

a lifting mechanism to lift and lower the compartments; and a control system to control the lifting and lowering by the lifting mechanism, such that a particular compartment is moved from its rest vertical position at the rest horizontal position to the loading vertical position at which the particular compartment at the height for loading onto the imager or unloading from the imager, and when the particular compartment is at its loading vertical position, the particular compartment is movable horizontally from and to the rest horizontal position to and from a loading horizontal position suitable for loading and unloading the plate on the compartment onto and from the imager, wherein the lifting mechanism is operative to lift and lower the compartments of the magazine one compartment at a time, and wherein the respective rest positions of each of the compartments are lower than the loading vertical position such that a particular compartment pre-loaded with a plate is lifted from its rest vertical position to the loading vertical position, then moved while at the loading vertical position to the loading horizontal position for loading onto the imager, the apparatus further comprising: an automatic plate loader to remove the plate from the particular compartment and load the plate onto the imager.

8. An apparatus to aid the loading and unloading of flexographic plates to and from an imager, the apparatus comprising:

a magazine containing plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager;

a lifting mechanism to lift and lower the compartments; and a control system to control the lifting and lowering by the lifting mechanism, such that a particular compartment is moved from its rest vertical position at the rest horizontal position to the loading vertical position at which the particular compartment at the height for loading onto the imager or unloading from the imager, and when the particular compartment is at its loading vertical position, the particular compartment is movable horizontally from and to the rest horizontal position to and from a loading horizontal position suitable for loading and unloading the plate on the compartment onto and from the imager, wherein the lifting mechanism is operative to lift and lower the compartments of the magazine one compartment at a time, and wherein the lifting mechanism is further operative to lift or lower the particular compartments each from the respective loading vertical position after the plate is imaged and unloaded from the imager to respective imaged vertical positions of the particular compartments, the apparatus further comprising:

an automatic plate loader to remove the plate from the particular compartment and load the plate onto the imager.

9. An apparatus to aid the loading and unloading of flexographic plates to and from an imager, the apparatus comprising:

a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager;

a lifting mechanism to lift and lower the compartments; and a control system to control the lifting and lowering by the lifting mechanism, such that a particular compartment is moved from its rest vertical position at the rest horizontal position to the loading vertical position at which the particular compartment at the height for loading onto the imager or unloading from the imager, and when the particular compartment is at its loading vertical position, the particular compartment is movable horizontally from and to the rest horizontal position to and from a loading horizontal position suitable for loading and unloading the plate on the compartment onto and from the imager, the apparatus further comprising:

an automatic plate loader to remove the plate from the particular compartment and load the plate onto the imager, wherein each compartment is for a single flexographic plate that may be covered by a protective sheet, and wherein the automatic plate loader includes an automatic protective sheet remover to remove the protective sheet when such a sheet is included on the plate, the removing prior to or during the loading of the plate onto the imager, and wherein the automatic plate loader includes:

a first mechanism including a first set of vacuum holders under control of the control system, the first mechanism movable to move a plate in the particular compartment to an intermediate horizontal position, the first mechanism under control of the control system further movable to move the plate from the intermediate horizontal position to an imager loading position.

10. An apparatus as recited in claim 9, wherein the compartment is moved to its loading horizontal position, and wherein the automatic plate loader moves the plate to the intermediate horizontal position when the compartment is in the loading horizontal position.

11. An apparatus as recited in claim 9, wherein the moving to the intermediate horizontal position is when the compartment is in its rest horizontal position, and wherein the automatic plate loader moving the plate from the intermediate horizontal position to an imager loading position includes moving the compartment from its rest horizontal position to its loading horizontal position.

12. An apparatus as recited in claim 9, wherein the imager is a drum imager that includes rotatable drum and a clamp on the drum to clamp a plate thereto, wherein the plate has a top side and a bottom side, and when at the intermediate horizontal position, a front edge close to the imager, and a far edge furthest from the imager, and wherein the automatic plate loader further includes:

a second mechanism including a second set of vacuum holders under control of the control system, the second mechanism movable under control of the control system and in the case that the plate includes a protective sheet on the top side, to hold the bottom of the plate at the intermediate horizontal position, the first mechanism further movable under control of the control system and in the case that the plate includes a protective sheet on the top side, to separate a small strip of the protective sheet along the front edge away from the plate while the second mechanism holds the bottom of the plate at the intermediate horizontal position, wherein the second mechanism under control of the control system and in the case that the plate includes a protective sheet on the top side, is further to let go of the bottom of the plate after the first mechanism has separated the edge of the protective sheet, wherein the first mechanism under control of the control system and in the case that the plate includes a protective sheet on the top side, is to move the plate to the imager loading position after the second mechanism has let go of the bottom of the plate such that the clamp of the drum may grab the front edge of the plate without the protective sheet thereon, such that after the clamp has grabbed the front edge of the plate, rotating the drum separates the sheet from the plate and loads the plate onto the drum.

13. An apparatus as recited in claim 12, wherein the automatic plate loader further includes a bending apparatus that under control of the control system automatically moves across the front edge of the plate to loosen the protective sheet from the plate in the case the plate includes a protective sheet thereon and when the plate is at the intermediate horizontal position.

14. An apparatus as recited in claim 12, wherein the automatic plate loader further includes an antistatic device to remove static electricity to ease separation of the protective sheet from the plate.

15. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager or unloading from the imager, (b) lifting or lowering the particular compartment from its rest vertical position at its rest horizontal position to its loading vertical position, (c) moving the particular compartment when at its loading vertical position from and to its rest horizontal position to and from a loading horizontal position suitable for loading and unloading the plate on the compartment onto and from the imager, (d) automatically removing the plate from its compartment at the loading horizontal position and loading the plate onto the imager, and (e) lifting or lowering the particular compartment from the loading vertical position after the plate is imaged and unloaded from the imager to an imaged vertical position for the particular compartment.

16. A method as recited in claim 15, wherein each compartment is for single flexographic plate that may be covered by a protective sheet, and wherein step (d) includes automatically removing the protective sheet when such a sheet is included on the plate, the removing prior to or during the loading of the plate onto the imager.

17. A method as recited in claim 15, wherein step (b) includes lifting or lowering the magazine of compartments until the particular compartment of the particular flexographic plate is at its loading vertical position.

18. A method as recited in claim 15, wherein step (b) includes lifting or lowering only the particular compartment of the magazine on the basis of one compartment being lifted or lowered at a time.

19. A method as recited in claim 15, wherein the magazine comprises at least 10 compartments.

20. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager or unloading from the imager, (b) lifting or lowering the particular compartment from its rest vertical position at its rest horizontal position to its loading vertical position, (c) moving the particular compartment when at its loading vertical position from and to its rest horizontal position to and from a loading horizontal position suitable for loading and unloading the plate on the compartment onto and from the imager, and (d) automatically removing the plate from its compartment at the loading horizontal position and loading the plate onto the imager, wherein step (b) includes lifting or lowering only the particular compartment of the magazine on the basis of one compartment being lifted or lowered at a time, and wherein the respective rest positions of each of the compartments are lower than the loading vertical position such that step (b) includes lifting the pre-loaded particular compartment from its rest vertical position to the loading vertical position, then moving the particular compartment while at the loading vertical position to the loading horizontal position for loading the plate onto the imager.

21. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager or unloading from the imager, (b) lifting or lowering the particular compartment from its rest vertical position at its rest horizontal position to its loading vertical position, (c) moving the particular compartment when at its loading vertical position from and to its rest horizontal position to and from a loading horizontal position suitable for loading and unloading the plate on the compartment onto and from the imager, and (d) automatically removing the plate from its compartment at the loading horizontal position and loading the plate onto the imager, wherein step (a) includes pre-loading the particular compartment with a pre-sensitized CTP flexographic plate such that as a result of the pre-loading, the particular plate is in the compartment without a cover sheet.

22. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager or unloading from the imager, (b) lifting or lowering the particular compartment from its rest vertical position at its rest horizontal position to its loading vertical position, (c) moving the particular compartment when at its loading vertical position from and to its rest horizontal position to and from a loading horizontal position suitable for loading and unloading the plate on the compartment onto and from the imager, and (d) automatically removing the plate from its compartment at the loading horizontal position and loading the plate onto the imager, the method further comprising transporting the magazine from a storage location to an imaging location adjacent to the imager.

23. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective, compartment is at a height for loading onto the imager or unloading from the imager, (b) lifting or lowering the particular compartment from its rest vertical position at its rest horizontal position to its loading vertical position.

(c) moving the particular compartment when at its loading vertical position from and to its rest horizontal position to and from a loading horizontal position suitable for loading and unloading the plate on the compartment onto and from the imager, and (d) automatically removing the plate from its compartment at the loading horizontal position and loading the plate onto the imager, wherein each compartment is for single flexographic plate that may be covered by a protective sheet, wherein step (d) includes automatically removing the protective sheet when such a sheet is included on the plate, the removing prior to or during the loading of the plate onto the imager, and wherein step (d) further includes:

moving the plate in the particular compartment from its position when the compartment is in the loading horizontal position to an intermediate horizontal position, and moving the plate from the intermediate horizontal position to an imager loading position where the plate is loaded onto the imager.

24. A method as recited in claim 23, wherein the imager is a drum imager that includes rotatable drum and a clamp on the drum to clamp a plate thereto, wherein the plate has a top side and a bottom side, and when at the intermediate horizontal position, the plate has a front edge close to the imager, and a far edge furthest from the imager, and wherein step (d) further includes:

in the case that the plate includes a protective sheet on the top side, holding the bottom of the plate at the intermediate horizontal position, separating a small strip of the protective sheet along the front edge away from the plate while the bottom of the plate is held at the intermediate horizontal position, after the separating, letting go of the bottom of the plate, moving the plate to the imager loading position after the letting go of the bottom of the plate, and clamping the front edge of the plate without the protective sheet thereon, such that after the clamping, rotating the drum separates the sheet from the plate and loads the plate onto the drum.

25. A method as recited in claim 24, wherein step (d) further includes:

in the case the plate includes a protective sheet thereon and when the plate is at the intermediate horizontal position prior to the holding of the bottom of the plate at the intermediate horizontal position, bending the front edge of the plate to loosen the protective sheet from the plate.

26. A method as recited in claim 24, wherein step (d) further includes:

in the case the plate includes a protective sheet thereon, removing static electricity to ease separation of the protective sheet from the plate.

* * * * *